US010413926B2

(12) United States Patent
Gonzalez et al.

(10) Patent No.: US 10,413,926 B2
(45) **Date of Patent: *Sep. 17, 2019**

(54) DUAL CHAMBER SPRAY DISPENSER WITH A SINGLE DELIVERY TUBE

(71) Applicant: THE CLOROX COMPANY, Oakland, CA (US)

(72) Inventors: German R. Gonzalez, Copley, OH (US); Riccardo Alluigi, Alessandria (IT)

(73) Assignee: The Clorox Company, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/902,754

(22) Filed: Feb. 22, 2018

(65) Prior Publication Data

US 2018/0178235 A1 Jun. 28, 2018

Related U.S. Application Data

(63) Continuation of application No. 15/132,075, filed on Apr. 18, 2016, now Pat. No. 9,931,657, which is a (Continued)

(30) Foreign Application Priority Data

Apr. 18, 2014 (IT) ..... BS2014A0085

(51) Int. Cl.
*B05B 11/00* (2006.01)

(52) U.S. Cl.
CPC ..... *B05B 11/3084* (2013.01); *B05B 11/0089* (2013.01); *B05B 11/3011* (2013.01); (Continued)

(58) Field of Classification Search
CPC ..... B05B 11/3084; B05B 11/3059; B05B 11/3057; B05B 11/3025; B05B 11/3011; (Continued)

(56) References Cited

U.S. PATENT DOCUMENTS 3,760,986 A * 9/1973 Castner ..... B05B 11/0056 222/137
4,355,739 A * 10/1982 Vierkotter ..... B05B 11/3083 222/134

(Continued)

FOREIGN PATENT DOCUMENTS

EP 0449046 A2 10/1991
EP 0449046 A3 10/1991

(Continued)

OTHER PUBLICATIONS

Ministero dello Sviluppo Economico, Rapporto Di Ricerca. Italian Ministry of Economic Development, Search Report. Application No. IO 47377/IT BS20140085. Jan. 7, 2015, Munich.

(Continued)

*Primary Examiner* — David P Angwin
*Assistant Examiner* — Bob Zadeh
(74) *Attorney, Agent, or Firm* — Erin Collins

(57) ABSTRACT

The present invention relates to fluid dispensing devices for use in dispensing different liquids (e.g., bleach and bleach activator) from a bottle having first and second compartments. To minimize the presence of mixed composition residually present within the fluid dispensing device, it may be helpful to delay mixing. Separate dip tubes may be provided to pull liquid from the separate compartments, each with its own separate pump. Each pump may deliver the separate compositions to a spray nozzle of the device through separate delivery tubes (e.g., from the pumps to the nozzle). In other embodiments, a single delivery tube, and/or (Continued)

a single pump may be provided, e.g., where the volume of mixed composition that may be present in such pump and/or delivery tube may be sufficiently small so as to still provide overall desired efficacy characteristics. Dual delivery tube configurations may eliminate any need to prime the device by spraying out old, residual mixed composition.

18 Claims, 32 Drawing Sheets

Related U.S. Application Data continuation-in-part of application No. 14/683,232, filed on Apr. 10, 2015, now Pat. No. 9,610,598.

(52) U.S. Cl.
CPC ..... *B05B 11/3014* (2013.01); *B05B 11/3025* (2013.01); *B05B 11/3057* (2013.01); *B05B 11/3059* (2013.01); *B05B 11/007* (2013.01); *B05B 11/0064* (2013.01); *B05B 11/3069* (2013.01)

(58) Field of Classification Search
CPC ..... B05B 11/0089; B05B 11/3014; B05B 11/3069; B05B 11/007; B05B 11/0064
See application file for complete search history.

(56) References Cited

U.S. PATENT DOCUMENTS 4,773,562 A * 9/1988 Gueret ..... A45D 40/24 222/135
5,009,342 A 4/1991 Lawrence ..... B05B 11/3083 222/136
5,152,431 A * 10/1992 Gardner ..... B05B 11/3081 222/136
5,152,461 A * 10/1992 Proctor ..... B05B 11/0064 239/304
5,339,990 A * 8/1994 Wilder ..... B05B 11/3001 222/135
5,385,270 A * 1/1995 Cataneo ..... B05B 11/3081 222/134
5,398,846 A * 3/1995 Corba ..... B05B 11/0029 222/1
5,402,916 A * 4/1995 Nottingham ..... B05B 11/3004 222/134
5,433,350 A * 7/1995 Graubart ..... B05B 11/3011 222/136
5,439,141 A * 8/1995 Clark ..... B05B 11/0056 222/136
5,472,119 A * 12/1995 Park ..... B05B 11/3081 222/136
5,535,950 A 7/1996 Barriac ..... B05B 11/3011 222/137
5,562,250 A * 10/1996 O'Neill ..... B05B 11/3004 222/136
5,609,299 A 3/1997 Foster ..... B05B 11/3011 222/137
5,626,259 A * 5/1997 Maas ..... B05B 11/3011 222/136
5,752,626 A 5/1998 Bachand ..... B05B 1/3436 222/136
5,769,275 A * 6/1998 Boehmer ..... B05B 11/00442 222/136
5,819,987 A * 10/1998 Miller ..... B05B 11/3081 222/135
5,839,621 A * 11/1998 Tada ..... B05B 11/0064 222/383.1
5,857,591 A 1/1999 Bachand ..... B05B 1/3436 222/1
5,887,761 A 3/1999 Foster ..... B05B 11/007 222/383.1
6,502,766 B1 1/2003 Streutker ..... B05B 9/0861 222/333
6,869,027 B2 3/2005 Foster ..... B05B 11/3009 222/383.1
6,978,946 B2 12/2005 Sweeton ..... B05B 11/3084 222/136
7,757,968 B2 7/2010 Bistolfi ..... B05B 1/341 222/137
7,832,654 B2 11/2010 Xu ..... B05B 7/2464 222/136
7,906,473 B2 3/2011 Williams ..... A47L 13/00 510/277
8,302,817 B2 * 11/2012 Saravis ..... B05B 11/3015 222/1
8,474,659 B2 * 7/2013 Dennis ..... B05B 15/30 222/137
8,562,907 B2 10/2013 Green ..... A01N 31/02 134/84
9,192,949 B2 11/2015 Lang ..... B05B 11/0018
9,610,598 B2 4/2017 Alluigi ..... B05B 11/3025
10,137,467 B2 * 11/2018 Alluigi ..... B05B 11/007
2001/0025860 A1 10/2001 Auer ..... B05B 11/3029 222/137
2004/0063600 A1 4/2004 Williams ..... A47L 13/00 510/375
2006/0163282 A1 7/2006 Suzuki ..... B05B 11/3011 222/135
2009/0308897 A1 12/2009 Foster ..... B05B 11/3011 222/383.1
2011/0272484 A1 11/2011 Richardson et al.
2012/0241475 A1 9/2012 Dennis ..... B05B 11/3009 222/137
2012/0280065 A1 11/2012 Foster et al.
2013/0202484 A1 8/2013 Green ..... A01N 31/02 422/28
2014/0061233 A1 3/2014 Lang ..... B05B 11/0018 222/1
2015/0298149 A1 10/2015 Alluigi ..... B05B 11/3025 222/135
2015/0375245 A1 12/2015 Burrowes ..... B05B 11/3001 222/136
2016/0228899 A1 8/2016 Gonzalez ..... B05B 11/3084
2016/0228900 A1 8/2016 Gonzalez ..... B05B 11/3084

FOREIGN PATENT DOCUMENTS

EP 0803295 A2 10/1997
EP 10043648 2/1998
EP 2000135457 5/2000
EP 2009125700 6/2009
JP 60005249 A * 1/1985 ..... B05B 11/3009
JP 10-43648 A 2/1998
JP 2000-135457 A 5/2000
JP 2009-125700 A 6/2009
WO 9831470 A1 7/1998

OTHER PUBLICATIONS

U.S. Consumer Product Safety Commission, retrieved from the Internet: http://www.cpsc.gov/pagefiles/115095/gualadispensing.pdf (retrieved on Jun. 28, 2016).
U.S. Non Final Office Action dated May 20, 2016 in U.S. Appl. 14/683,232; including PTO892 Examiner References (1 page).
U.S. Notice of Allowance and Fee(s) Due dated Nov. 21, 2016 in U.S. Appl. 14/683,232; including PTO892 Examiner References (1 page).
U.S. Non Final Office Action dated Jul. 14, 2017 in U.S. Appl. 15/132,075; including PTO892 Examiner References (3 pages).

* cited by examiner

DUAL CHAMBER SPRAY DISPENSER WITH A SINGLE DELIVERY TUBE

CROSS-REFERENCE TO RELATED APPLICATIONS

The present application is a continuation of U.S. patent application Ser. No. 15/132,075, filed on Apr. 18, 2016, which is in turn a continuation in part of U.S. patent application Ser. No. 14/683,232, filed Apr. 10, 2015 and entitled "TRIGGER-DISPENSING DEVICE FOR TWO OR MORE LIQUIDS", which is now U.S. Pat. No. 9,610,598, which in turn claims the benefit of Italian Patent Application Serial No. BS2014A000085, filed Apr. 18, 2014. The disclosure of each of the above patent applications is incorporated by reference in its entirety.

BACKGROUND OF THE INVENTION

1. Technical Field

Embodiments within the scope of the invention relate to a manual trigger-dispensing device for liquids for at least two substances, generally liquids, for example for the hygiene of the home, hospitals, restaurants, retail centers, deodorization of rooms, the treatment of fabrics before ironing, and the like.

2. Description of the Related Art

Trigger devices are very widespread, as can be seen on supermarket shelves, and are especially prevalent due to their ease of use and functionality. Every year many hundreds of millions of pieces are produced. Among numerous types, there exist devices for dispensing two or more substances. By way of example, some compositions may exhibit increased efficacy when mixed or applied with another, companion composition.

There are trigger-dispensing device solutions for two or more substances, although the existing solutions sometimes may not provide good mixing of the substances to be combined (e.g., particularly at a desired ratio). In addition, it can be important to minimize or even eliminate the volume of any residual mixed composition still present within the dispensing device after a given use. Such problems frustrate the main purpose of such devices.

BRIEF SUMMARY

Embodiments within the scope of the present invention provide a trigger-dispensing device for two or more substances that addresses one or more problems existing in the art. In an embodiment, this is achieved by providing a dispensing head of a trigger-actuated fluid dispensing device, wherein the head comprises a trigger and pumping means (e.g., pumps) operable by the trigger to substantially simultaneously aspirate at least two substances, and achieve dispensing, wherein the means for pumping are suitable for carrying out a predetermined pre-compression of these substances, separately and substantially simultaneously before dispensing.

According to an embodiment, a fluid dispensing device is provided including a bottle with first and second compartments. The bottle may include a front side, a back side, a bottom, and a neck top, with a bottle coupling portion below the neck top. A dispensing head may include a frame, a trigger, and first and second pumps (e.g., reciprocating pumps). First and second dip tubes may be provided, fluidly connected to the first and second pumps, respectively, to pull first and second fluids (e.g., liquids) from interior volumes of the first and second compartments of the bottle. A nozzle may be provided which fluidly communicates with first and second delivery tubes, which may deliver the first and second fluids from the first and second dip tubes, (e.g., the delivery tubes may be downstream from the pumps, with the pumps between the dip tubes and the delivery tubes). The fluid dispensing device may be configured to maintain the first and second fluids separate from one another, until they reach the nozzle, so that the dispensing device includes no more than about 0.2 mL of mixed first and second fluids, at any given time.

For example, mixing may be delayed until the fluids are actually dispensed, or at least until the two fluids enter the nozzle, e.g., just prior to being dispensed. Such a configuration advantageously may ensure that little, if any, mixed composition is stored or present within the fluid dispensing device, but mixing only occurs at or near the point of delivery (e.g., spraying out from the dispensing head). For example, an exemplary mixed composition may be efficacious for a period of only about 2 minutes once mixed. It would be detrimental for such a mixed composition to sit for a prolonged period of time within a delivery tube or other portion of the dispensing device. For example, this might require an end user to empty mixed composition that continues to reside within the delivery tube or elsewhere, before spraying "fresh" mixed composition that would provide the intended efficacy. Thus, in at least some embodiments, minimization of such residually present mixed composition may be advantageous.

Another embodiment is directed to a fluid dispensing device including a bottle with first and second compartments for holding first and second fluids. The bottle may include a front side, back side, a bottom, and first and second necks. A bottle coupling (e.g., a snap coupling) may be provided below a top of the first and second necks of the bottle. The first compartment may be positioned adjacent the front side of the bottle, and the second compartment may be adjacent the back side of the bottle (e.g., one behind the other). The device may further include a dispensing head including a frame, a trigger, a first pump, and a second pump. The first pump may be closer to the front dispensing end of the device, while the second pump may be closer (as compared to the first pump) to the back side of the bottle, so that the pumps are also one behind the other (i.e., in front to back alignment). A transmission member may be provided, which translates actuation of the trigger into simultaneous or substantially simultaneous actuation of both pumps. First and second dip tubes may be provided, with fluid communication to the respective pumps and the interior volumes of the first and second compartments each housing their respective fluids. A nozzle may be provided, which fluidly communicates with a first delivery tube and a second delivery tube (e.g., with the pumps disposed between delivery tubes and the dip tubes in the interior volumes of the bottle compartments). Such separate delivery tubes, pumps, compartments, and dip tubes, helps to ensure that the two fluids are not mixed prematurely, and to ensure that minimal mixed composition is stored within the dispensing device, to ensure high efficacy. For example, mixing may first occur within the spray nozzle, just prior to dispensing, or even on the surface the mixture is being sprayed on.

Another embodiment relates to a fluid dispensing device including a bottle with first and second compartments for holding first and second fluids. The bottle may include a front side, back side, a bottom, and first and second necks. A bottle coupling may be provided below a top of the first and second necks of the bottle. The device may further include a dispensing head including a frame, a trigger, a first pump, and a second pump. First and second dip tubes may be provided, with fluid communication to the respective pumps and the interior volumes of the first and second compartments each housing their respective fluids. A nozzle may be provided, which fluidly communicates with a first delivery tube and a second delivery tube (e.g., with the pumps disposed between the delivery tubes and the dip tubes). The two delivery tubes may be vertically aligned within one another (e.g., in a vertical plane passing through the two tubes, for example, one above the other). The device may be configured so that the first and second pumps deliver substantially the same volume of the first and second fluids to the nozzle, substantially simultaneously, upon actuation of the trigger, allowing the dispensing device to aspirate and deliver about an approximately 1:1 mixture of the first and second fluids.

The above described embodiments may include two separate delivery tubes, as described. Other embodiments may include a single delivery tube, e.g., where the presence of residual mixed composition in the delivery tube may not be overly detrimental, the volume within such a single delivery tube may be minor, or the like. For example, such an embodiment of a fluid dispensing device may include a bottle with first and second compartments for holding first and second fluids. The bottle may include a front side, a back side, a bottom, and a neck. A bottle coupling may be provided below a top of the neck. The device may further include a dispensing head including a frame, a trigger, a first pump, and a second pump. First and second dip tubes may be provided, with fluid communication to the respective pumps and the interior volumes of the first and second compartments each housing their respective fluids. A single delivery tube may be provided, fluidly connected to the first and second pumps. A nozzle may be provided, which fluidly communicates with the single delivery tube (e.g., with the pumps disposed between delivery tube and the dip tubes). The first and second fluids may come into contact for the first time within the single delivery tube.

Another embodiment is directed to a fluid dispensing device including a bottle with first and second compartments for holding first and second fluids. The bottle may include a front side, a back side, a bottom, and first and second necks. A bottle coupling (e.g., a snap coupling) may be provided below a top of the first and second necks of the bottle. The first compartment may be positioned adjacent the front side of the bottle, and the second compartment may be adjacent the back side of the bottle (e.g., one behind the other). The device may further include a dispensing head including a frame, a trigger, a first pump, and a second pump. The first pump may be closer to the front dispensing end of the device, while the second pump may be closer (as compared to the first pump) to the back side of the bottle, so that the pumps are also one behind the other (i.e., in front to back alignment). A transmission member may be provided, which translates actuation of the trigger into substantially simultaneous actuation of both the pumps. First and second dip tubes may be provided, with fluid communication to the respective pumps and the interior volumes of the first and second compartments each housing their respective fluids. A single delivery tube may be provided, fluidly connected to the first pump and the second pump. A nozzle may be provided, which fluidly communicates with the delivery tube (e.g., with the pumps disposed between the delivery tube and the dip tubes along the fluid pathway).

Another embodiment is directed to a fluid dispensing device including a bottle with first and second compartments for holding first and second fluids. The bottle may include a front side, a back side, a bottom, and first and second necks. A bottle coupling may be provided below a top of the first and second necks of the bottle. The device may further include a dispensing head including a frame, a trigger, a first pump, and a second pump. A transmission member may be provided, which translates actuation of the trigger into substantially simultaneous actuation of both the pumps. First and second dip tubes may be provided, with fluid communication to the respective pumps and the interior volumes of the first and second compartments each housing their respective fluids. A single delivery tube may be provided, fluidly connected to the first pump and the second pump. A nozzle may be provided, which fluidly communicates with the delivery tube (e.g., with the pumps disposed between the delivery tube and the dip tubes). The transmission member may be positioned above the single delivery tube.

Another embodiment may be such as any of those described above, e.g., including a single delivery tube, and which may also include a single pump (e.g., drawing from both bottle compartments), rather than dual pumps. For example, two dip tubes may be provided, which feed liquids into a single pump (e.g., including two inlets), through an outlet, and into the delivery tube.

Further features and advantages of example embodiments of the present invention will become apparent to those of ordinary skill in the art in view of the detailed description of preferred embodiments below.

BRIEF DESCRIPTION OF THE DRAWINGS

To further clarify the above and other aspects of example embodiments of the present invention, a more particular description of the invention will be rendered by reference to specific embodiments thereof which are illustrated in the drawings located in the specification. It is appreciated that these drawings depict only exemplary embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

I. Definitions

Figure 1:
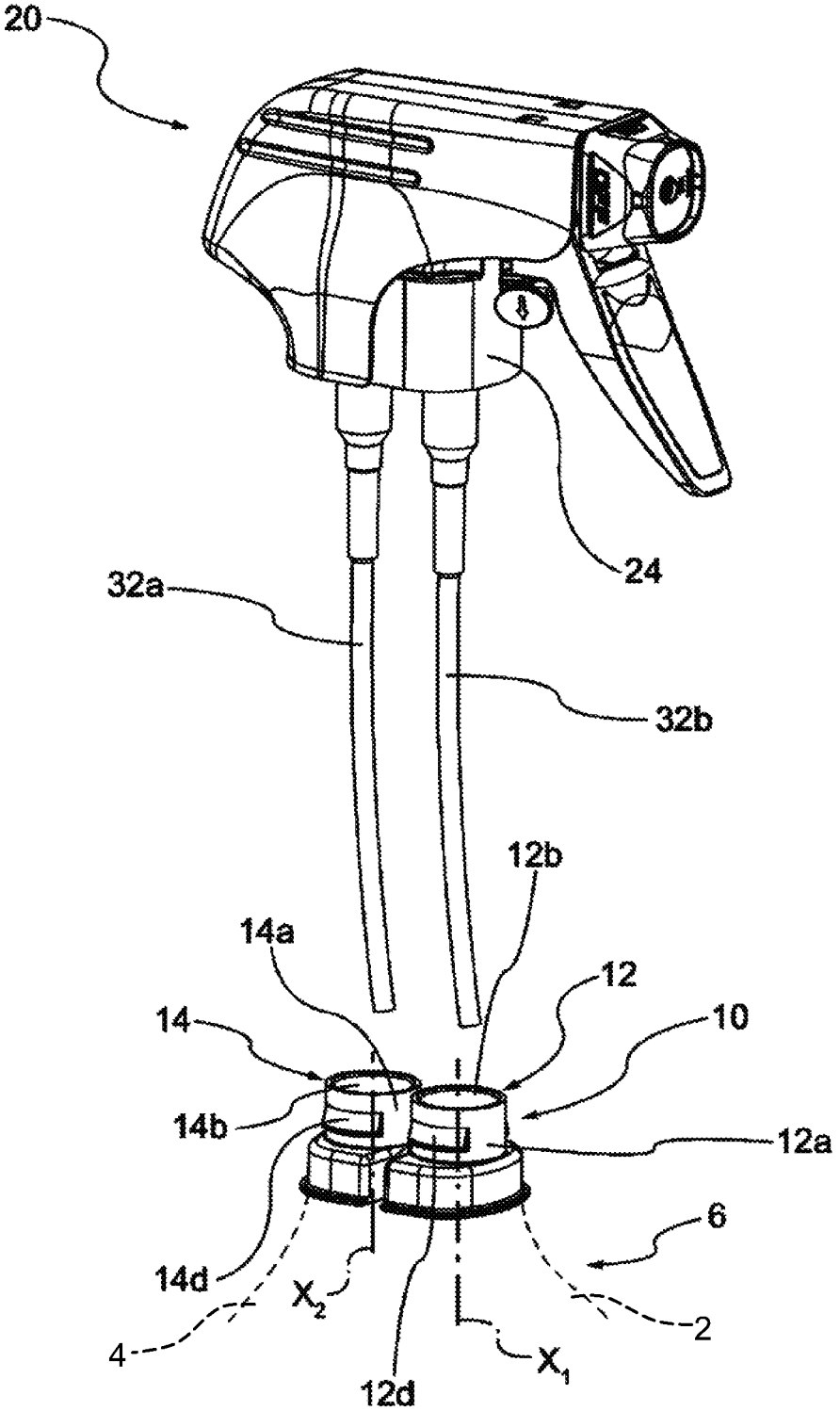
FIG. 1 shows a perspective view of a trigger-actuated fluid dispensing device for dispensing two substances according to an embodiment of this invention, comprising a dispensing head and a bottle, which are shown separated in FIG. 1.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," or "containing," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "surfactant" includes one, two or more surfactants.

Compositions delivered by the described dispensing devices may provide sanitization, disinfection, sterilization, or other treatment. As used herein, the term "sanitize" means the reduction of contaminants in the inanimate environment to levels considered safe according to public health ordinance, or that reduces the bacterial population by significant numbers where public health requirements have not been established. By way of example, an at least 99% reduction in bacterial population within a 24 hour time period is deemed "significant." Greater levels of reduction are possible, as are faster treatment times (e.g., within 1 minute or even less), when sanitizing. As used herein, the term "disinfect" means the elimination of many or all pathogenic microorganisms on surfaces with the exception of bacterial endospores. As used herein, the term "sterilize" means the complete elimination or destruction of all forms of microbial life and which is authorized under the applicable regulatory laws to make legal claims as a "sterilant" or to have sterilizing properties or qualities. By way of example, some two-part bleach compositions delivered using the described dispensing devices may provide for at least a 3 or more log reduction in bacterial population within a designated time period. A 3-log reduction is equivalent to at least a 99.9% reduction, a 4-log reduction is equivalent to at least a 99.99% reduction, a 5-log reduction is equivalent to at least a 99.999% reduction, etc.

Unless otherwise stated, all percentages, ratios, parts, and amounts used and described herein are by weight.

Numbers, percentages, ratios, or other values stated herein may include that value, and also other values that are about or approximately the stated value, as would be appreciated by one of ordinary skill in the art. A stated value should therefore be interpreted broadly enough to encompass values that are at least close enough to the stated value to perform a desired function or achieve a desired result, and/or values that round to the stated value. The stated values include at least the variation to be expected in a typical manufacturing or formulation process, and may include values that are within 10%, within 5%, within 1%, etc. of a stated value. Furthermore, the terms "substantially", "similarly", "about" or "approximately" as used herein represent an amount or state close to the stated amount or state that still performs a desired function or achieves a desired result. For example, the term "substantially" "about" or "approximately" may refer to an amount that is within 10% of, within 5% of, or within 1% of, a stated amount or value.

Some ranges may be disclosed herein. Additional ranges may be defined between any values disclosed herein as being exemplary of a particular parameter. All such ranges are contemplated and within the scope of the present disclosure.

In the application, effective amounts are generally those amounts listed as the ranges or levels of ingredients in the descriptions, which follow hereto. Unless otherwise stated, amounts listed in percentage ("%'s") are in weight percent (based on 100% active) of a cleaning or other composition.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

II. Introduction

The present invention is directed to fluid dispensing devices for use in dispensing different liquids (e.g., approximately equal volumes thereof) from a bottle having first and second compartments. For example, when dispensing a bleach containing sanitizing composition, it can be beneficial to include a bleach activator within the dispensed composition to improve the efficacy of the bleach component alone. A problem with such compositions is that the bleach activator is not compatible for storage in combination with the bleaching agent. As such, one solution to this problem is to provide the bleach containing composition in a first compartment, and to provide the bleach activator in a second compartment. The two compositions are mixed together at the time the compositions are dispensed. For example, such mixed bleach compositions exhibiting increased efficacy may exhibit efficacy that lasts for a short period of time following mixing (e.g., about 2 minutes after mixing).

Because of the short time period of efficacy after mixing, it can be important according to some embodiments to ensure that minimal or no mixed composition remains residually within the fluid dispensing device. For example, separate dip tubes may be provided to pull liquid from the separate compartments, each with its own separate pump. Each pump may deliver the separate compositions to a nozzle (e.g., a spray nozzle) of the device through separate delivery tubes (e.g., from the pumps to the nozzle). Such separate delivery tubes may be preferred for limiting mixing of the components before use. In another embodiment, a single delivery tube from the two pumps may be provided, e.g., where the volume of mixed composition that may be present within such a delivery tube may be sufficiently small so as to still provide overall desired efficacy characteristics. In yet another embodiment, a single delivery tube and single pump may be provided (e.g., perhaps where mixing within such pump and/or delivery tube is not overly detrimental).

One advantage of a dual delivery tube configuration is that any residual mixed composition present within a single delivery tube may need to be sprayed out, before new, "fresh" mixed composition having the desired characteristics can be dispensed. In other words, it may be important to "prime" the device, by emptying mixed composition (e.g., within a single delivery tube and/or pump) before spraying "fresh" mixed composition onto a desired surface to be sanitized, disinfected, or otherwise treated. For at least these reasons, a dual delivery tube configuration may be preferred in at least some embodiments and applications.

III. Exemplary Dispensing Devices

FIGS. 1-11 illustrate a first exemplary dispensing device, including dual delivery tubes. FIGS. 12-16 illustrate another exemplary dispensing device, also including dual delivery tubes. FIGS. 17-21 illustrate another exemplary dispensing device, this one including a single delivery tube. FIGS. 22-26E illustrate another exemplary dispensing device, with a single delivery tube, and a single pump. Referring to FIGS. 1-11, 1 generally indicates a trigger dispensing device for two or more substances, generally liquids.

For clarity of exposition, hereinafter we will refer to variants of the invention for two substances, without precluding the extension of the innovative features to more than two substances.

The device 1 comprises a first containment compartment and a second containment compartment, separated from each other, respectively for the containment of a first substance and a second substance, e.g., usually liquids.

For example, the device 1 comprises a bottle 6 made in a single piece, for example of plastic, provided internally with a partition wall that separates the two containment compartments. Bottle 6 may also be made in two separate pieces.

Preferably, the bottle 6 includes a bottle coupling portion 10 for the attachment of a pre-assembled dispensing head 20.

For example, the bottle coupling portion 10 includes a first neck 12 and a second neck 14, comprising respective annular neck walls 12*a*, 14*a*, for example cylindrical, that define respective rectilinear coupling axes X1, X2, parallel to each other. As shown in FIG. 1, the axes X1 and X2 may be oriented one behind the other, relative to the front of the dispensing head 20, as shown.

The neck walls 12*a*, 14*a* define respective openings 12*b*, 14*b* for access to the respective containment compartments.

Preferably, the dispensing head 20 can be snap-coupled to the bottle 6. For example, the coupling portion may include fins for snap coupling; for example, each neck 12, 14 may comprise coupling fins 12*d*, 14*d*, protruding outward from the respective neck wall 12*a*, 14*a*. For example, the coupling fins may form two pairs, one for each neck 12, 14. The fins of each pair may have the same angular extension and may be arranged symmetrically protruding from the neck, with respect to an imaginary plane containing the two coupling axes X1, X2.

The dispensing head 20 may preferably be pre-assembled and applied to the bottle 6 after filling of the bottle with the substances to be dispensed. Once attached, the coupling mechanism (e.g., a snap coupling) may be such as to prevent removal of the head from the bottle. For example, the two may be permanently attached together.

The head 20 may comprise a frame or chassis 22 for the support of the components. Preferably, the frame 22 can be snap-coupled to the bottle 6.

For example, the frame 22 may comprise an annular coupling head wall 24 suitable to externally surround the necks 12, 14 of the bottle, and may be provided with counter-coupling fins for snap engagement with the fins 12*d*, 14*d* of the necks 12, 14.

The head 20 may comprise pumping means capable of substantially simultaneous operation, substantially simultaneously achieving suction and pre-compression for two or more substances, providing separate or combined dispensing of the substances.

Figure 5:
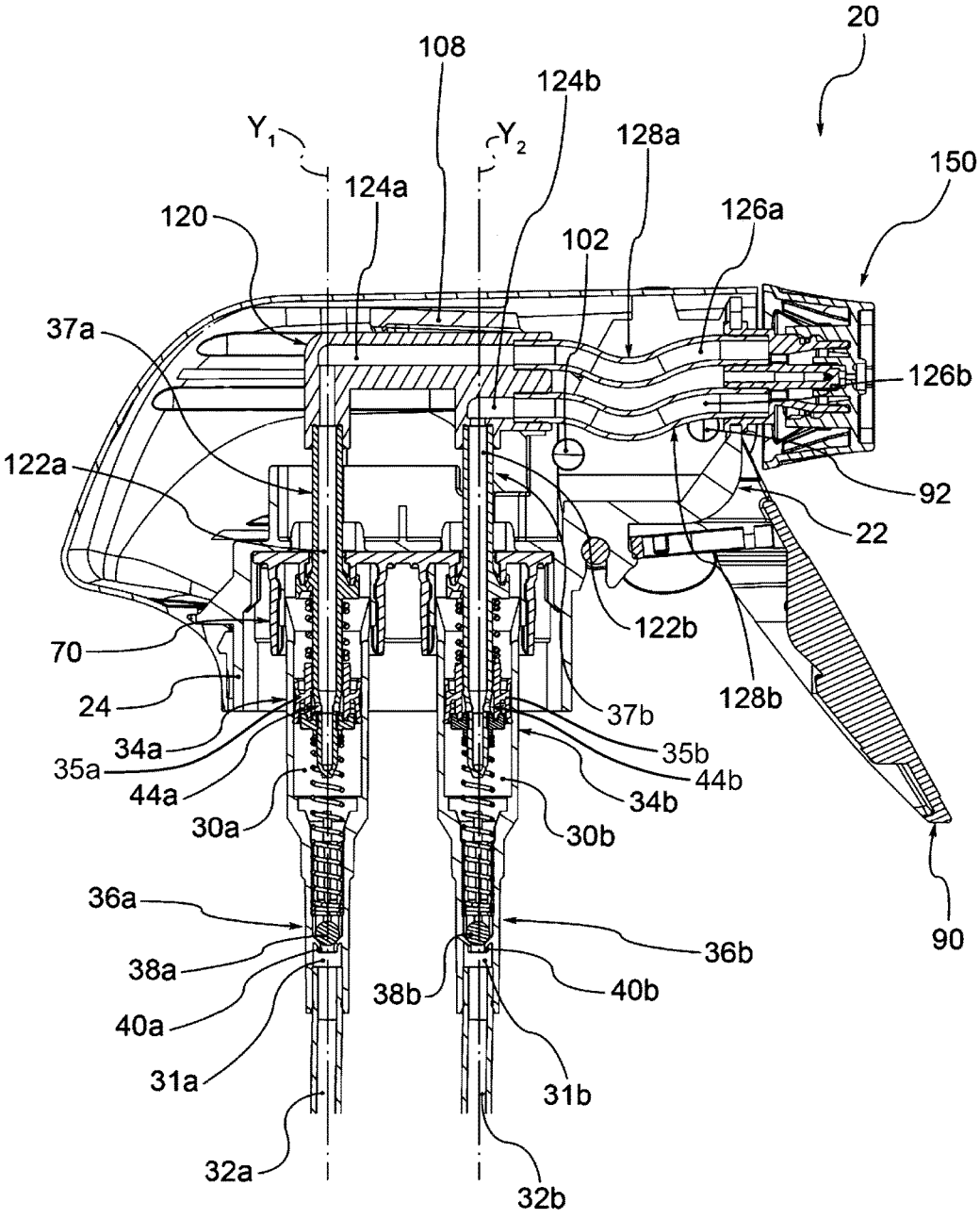
FIG. 5 shows a cross-sectional view through the dispensing head of FIG. 3.
Figure 6:
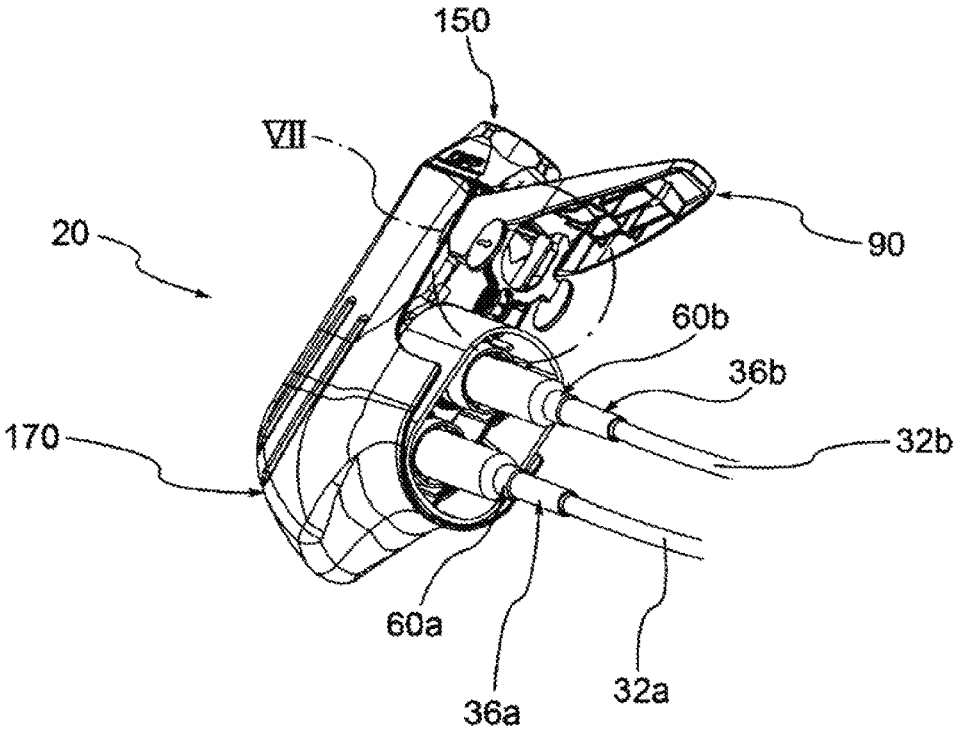
FIG. 6 shows a lower perspective view of dispensing head of FIG. 3, to better show the underside thereof.
Figure 7:
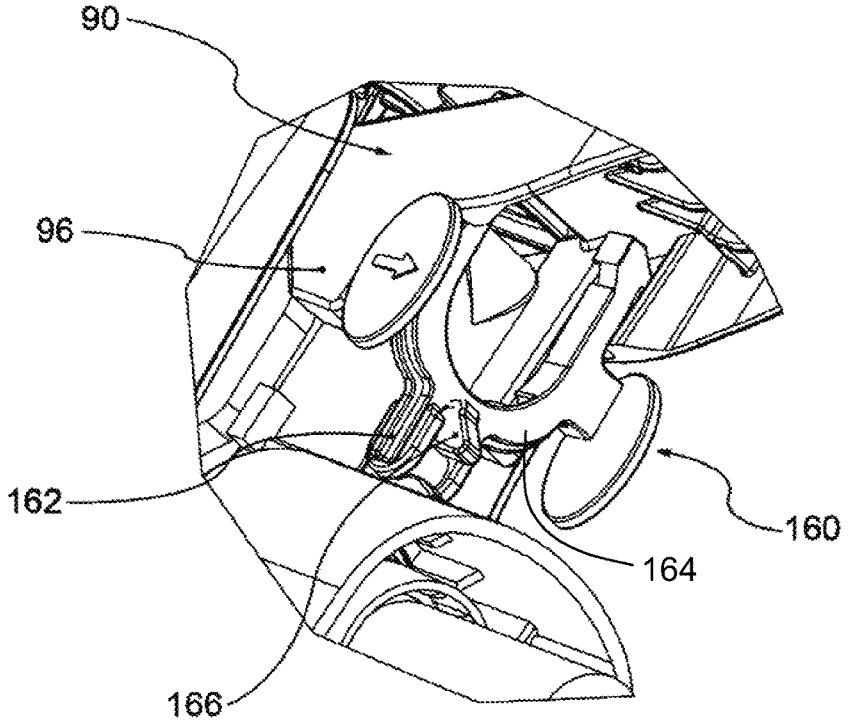
FIG. 7 shows an enlargement of detail VII from FIG. 6.

As shown in FIG. 5, the pumping means may comprise a first pressure chamber 30*a* and a second pressure chamber 30*b* suitable for placement in communication with the first containment compartment and the second containment compartment, respectively of the bottle 6. Access to chambers 30*a* and 30*b* may be through respective inlet openings 31*a*, 31*b*, for example by means of respective tubes 32*a*, 32*b* (e.g., dip tubes) applied to the inlet openings 31*a*, 31*b*.

Furthermore, the head 20 may comprise a first dispensing duct 40*a* and a second dispensing duct 40*b* for the dispensing of the substances from the respective pressure chambers 30*a*, 30*b*.

The pumping means may further comprise a first piston 34*a* and a second piston 34*b* suitable to operate in the respective pressure chambers 30*a*, 30*b* to pressurize the substances contained therein, for example, for translation along respective piston axes Y1, Y2.

Preferably, each piston 34*a*, 34*b* may comprise a piston head 35*a*, 35*b* and a piston rod 37*a*, 37*b*, that extends along the respective piston axes Y1, Y2 and that support the respective piston heads 35*a*, 35*b*.

Furthermore, the pumping means may comprise suction valve means suitable to allow the transit of a substance from a respective containment compartment 2, 4 of the bottle 6 to the respective pressure chamber 30*a*, 30*b* during a suction phase and prevent the return of the substance from the respective pressure chamber 30*a*, 30*b* to the respective containment compartment 2, 4 during a pre-compression step.

For example, the suction valve means may comprise a first check valve 36*a*, positioned between a first inlet opening 31*a* and the first pressure chamber 30*a*, and a second check valve 36*b*, positioned between a second inlet opening 31*b* and the second pressure chamber 30*b*.

According to an embodiment, the check valves 36*a*, 36*b* may comprise an obturator 38*a*, 38*b*, sensitive to the action of the substance present in the pressure chamber 30*a*, 30*b*, for example in the form a ball, and an obturator seat 40*a*, 40*b*.

In addition, the pumping means may comprise pre-compression valve means suitable to allow the passage of substances from respective pressure chambers 30*a*, 30*b* to the respective delivery ducts 40*a*, 40*b* when the pressure of the substances in the pressure chambers exceeds a predefined threshold pressure and suitable to prevent the transit of the substances from the respective pressure chambers 30*a*, 30*b* to the respective delivery ducts 40*a*, 40*b* when the pressure of the substances in the pressure chambers is less than a predefined threshold pressure.

Preferably, the pressure threshold may be greater than 1 bar; more preferably, the pressure threshold may be greater than 3 bar.

Figure 8:
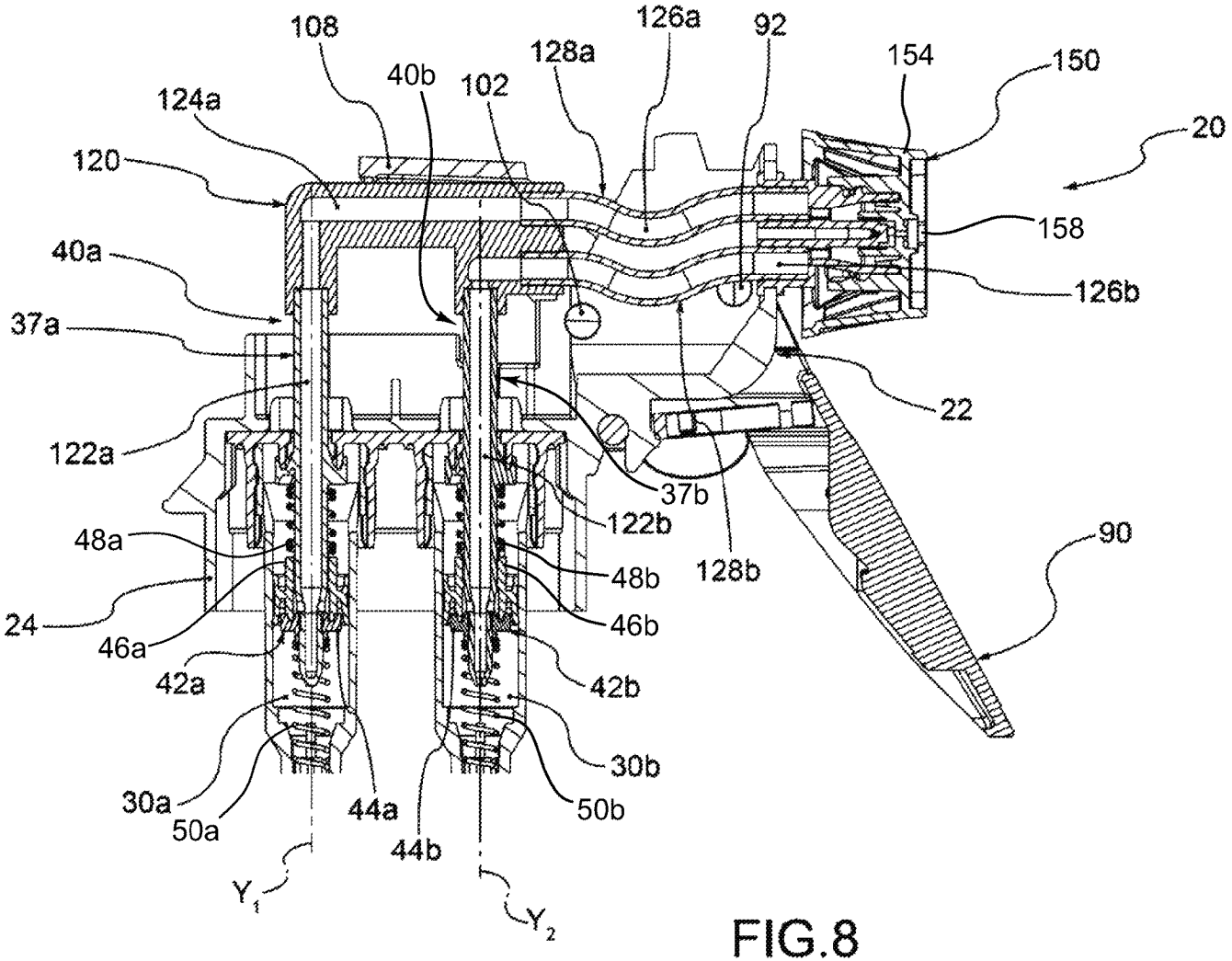
FIG. 8 shows a cross-sectional view of the dispensing head of FIG. 5, with the cover removed.

For example, referring to FIG. 8, the pre-compression valve means may comprise a first pre-compression valve 42*a*, operating between the first pressure chamber 30*a* and the first delivery duct 40*a*, and a second pre-compression valve 42*b* (see FIG. 8), operating between the second pressure chamber 30*b* and the second delivery duct 40*b*.

For example, the pre-compression valves 42*a*, 42*b* may each comprise an obturator plate 44*a*, 44*b*, a piston head body 46*a*, 46*b*, a pre-compression spring 48*a*, 48*b* (which presses on the piston head body 46*a*, 46*b*) and a return spring 50*a*, 50*b* (which presses on the obturator plate 44*a*, 44*b*).

In the step of substantially simultaneous pre-compression of the substances, the pre-compression spring 48*a*, 48*b* and the return spring 50*a*, 50*b*, which work in an antagonistic manner, hold integral between them the obturator plate 44*a*, 44*b* and the piston head body 46*a*, 46*b*, closing the access of the pressure chamber 30*a*, 30*b* to the respective delivery duct 40*a*, 40*b*.

The assembly formed by the obturator plate 44*a*, 44*b* and the piston head body 46*a*, 46*b* operates from the piston head 35*a*, 35*b*, which compresses the substance in the pressure chamber 30*a*, 30*b*.

The action of the piston 34*a*, 34*b* produces a pressure increase in the pressure chamber 30*a*, 30*b*, until the predetermined threshold pressure is exceeded.

Since the pre-compression spring 50*a*, 50*b* works in opposition to the action of the pressure in the pressure chamber 30*a*, 30*b*, upon reaching the threshold pressure, the piston head body 46*a*, 46*b* separates from the obturator plate 44*a*, 44*b*, opening the access to the respective delivery duct 40*a*, 40*b*, substantially simultaneously for the two substances.

Figure 2:
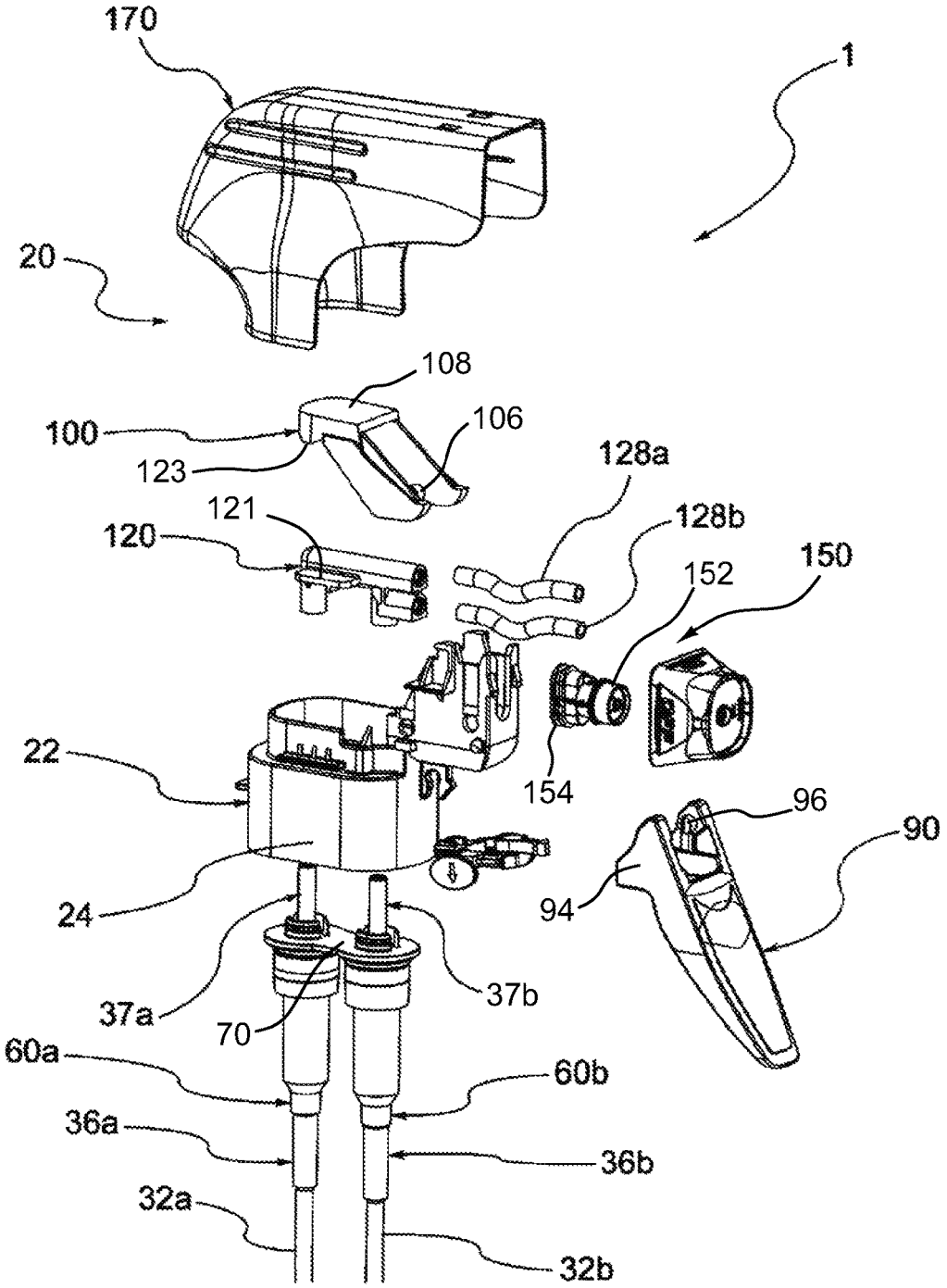
FIG. 2 shows an exploded view of the dispensing head of the device of FIG. 1.
Figure 3:
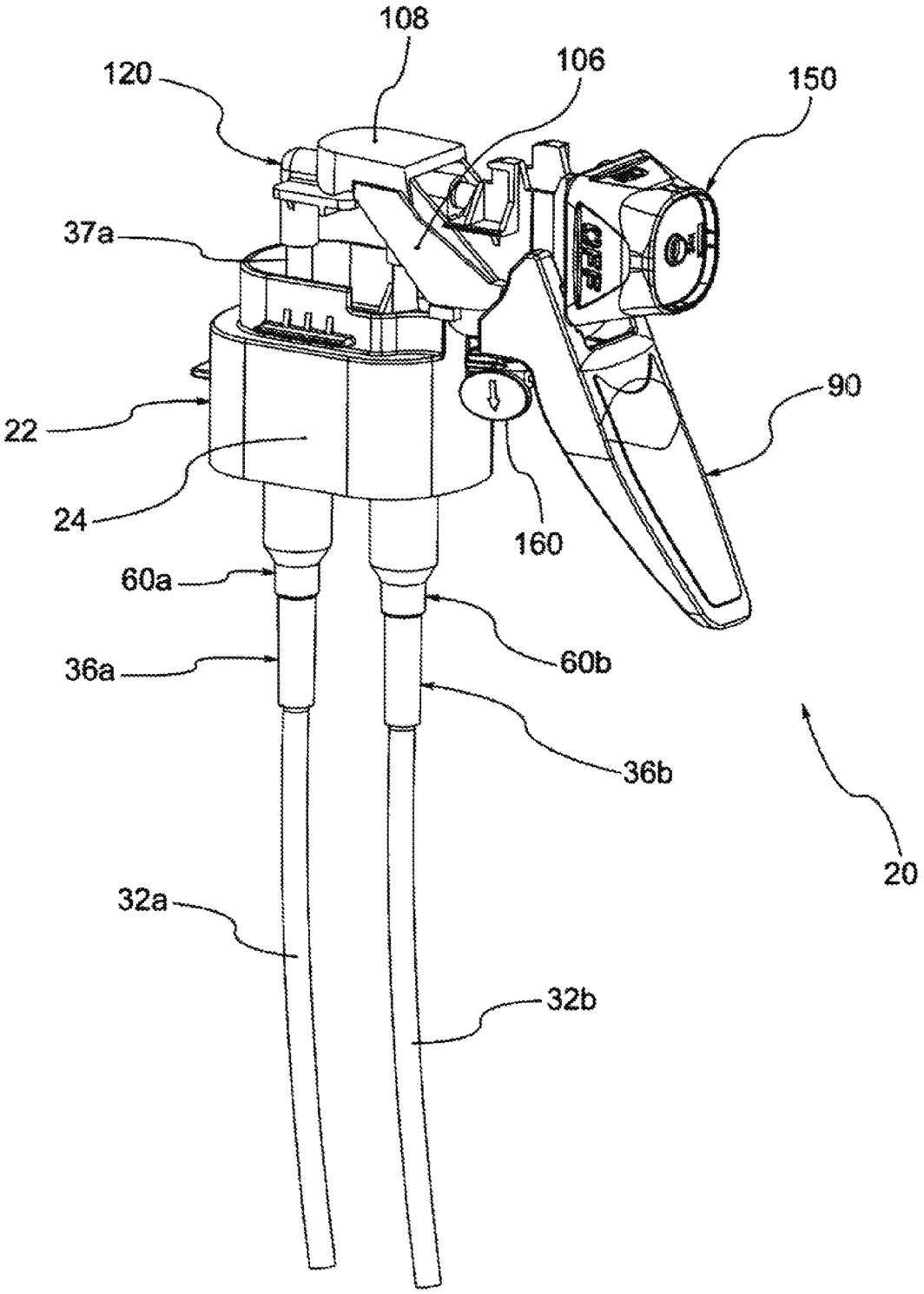
FIG. 3 shows the dispensing head according to a front perspective view, with the dispensing head assembled.
Figure 4:
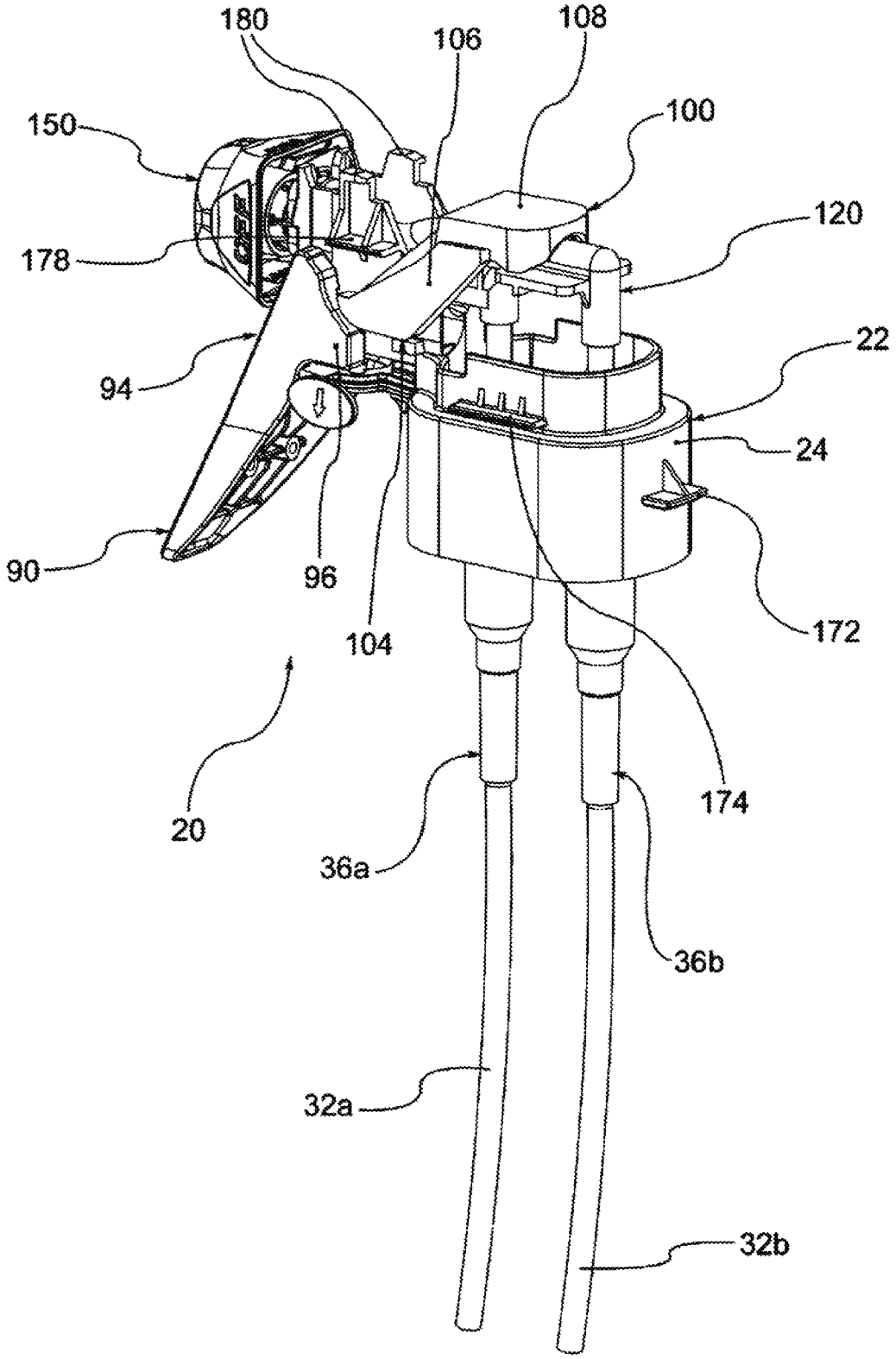
FIG. 4 shows a rear perspective view of the dispensing head of FIG. 3.

Preferably, as seen in FIGS. 2-3, the pumping means may comprise a first hollow casing 60*a* and a second hollow casing 60*b*, having prevailing extension along the respective piston axes Y1, Y2.

Inside each casing 60*a*, 60*b*, the pressure chamber 30*a*, 30*b* is formed. The piston 34*a*, 34*b* is operated, for example, slidingly, and the check valve 36*a*, 36*b* and the pre-compression valve 42*a*, 42*b* may be housed within casings 60*a*, 60*b*.

Preferably the dispensing head 20 may comprise a connecting flange 70, bridging the casings 60*a*, 60*b* for the simultaneous connection of the two casings 60*a*, 60*b* to the frame 22.

The casings 60*a*, 60*b* may be applied to the flange 70, which is, in turn, affixed to the frame 22. From the flange 70, the piston rods 37*a*, 37*b* may protrude axially (see FIG. 5).

Furthermore, the dispensing head 20 may comprise a trigger 90 hinged to the frame 22 at a trigger-connection point 92, and actuation means, operable from the trigger 90, for the substantially simultaneous activation of the pistons 34*a*, 34*b*.

In a preferred embodiment, the actuation means may comprise a transmission member 100, hinged to the frame 22 at a pivot point 102, engageable by the trigger 90, so that a rotation of the trigger 90 corresponds to a counter-rotation of the transmission member 100.

In particular, having defined an imaginary plane containing the two piston axes Y1, Y2, for the dispensing head 20 (and for the device 1), a right side is defined by one part of the imaginary plane, and a left side by the other part. Preferably, the imaginary plane so defined intersects the trigger 90.

Preferably, as perhaps best seen in FIG. 2, the trigger 90 comprises a trigger engagement portion 94 for engagement with the transmission member 100, wherein the portion 94 includes two protrusions 96, one on one side and one on the other side of the dispensing head 20. Protrusions 96 hingedly couple trigger 90 to frame 22.

Similarly, the transmission member 100 comprises an engagement portion 104 for engagement with the trigger 90, wherein the portion 104 comprises two elongations 106, one on one side and one on the other side of the dispensing head 20.

The transmission member 100 also includes a main portion 108, straddling between the sides of the dispensing head 20, from which protrude the elongations 106. Elongations 106 hingedly couple transmission member 100 to the frame 22, in a manner that actuation of trigger 90 causes rotation of transmission member 100.

Moreover, the actuation means may comprise an intermediate body 120, engageable by the transmission member 100 and suitable to translate vertically, along the pistons axes Y1, Y2. For example, intermediate body 120 may include flanges 121, which extend laterally outward from body 120, and are engaged by the underside of main portion 108 of transmission member 100 (e.g., protrusion 123 thereof). The two pistons 34*a*, 34*b*, and in particular the two piston rods 37*a*, 37*b*, may be integrally connected to the intermediate body 120. Actuation of trigger 90 thus causes counter-rotation of transmission member 100, with the underside of protrusion 123 engaging flanges 121. Underside of protrusion 123 translates vertically, applying a downward force to flanges 121 (and thus entire intermediate body 120).

In other words, the rotation of the trigger 90, for example clockwise, by manual action of a user of the device 1, causes the counter-rotation, for example counter-clockwise, of the transmission member 100, which in turn pushes the intermediate body 120, to which are integrally connected the two pistons 34*a*, 34*b*, which are so actuated in compression.

According to a preferred embodiment, as shown, the delivery ducts 40*a*, 40*b* may pass through the piston rods 37*a*, 37*b* and the intermediate body 120.

In particular, each delivery duct 40*a*, 40*b* may include an initial section 122*a*, 122*b* that extends inside the respective piston rod 37*a*, 37*b*, an elbow section 124*a*, 124*b* that extends inside the intermediate body 120, and an end section 126*a*, 126*b* that extends in extension tubes (e.g., flexible delivery tubes) 128*a*, 128*b* sealingly applied to (e.g., inserted into) the intermediate body 120, up to a nozzle group (nozzle assembly) 150 applied to the frame 22.

The extensible or flexible tubes 128*a*, 128*b* are suitable to compensate for the variation of position between the intermediate body 120 and the nozzle 150 due to the movement undergone by the intermediate body 120 during the pre-compression step with respect to the nozzle group or assembly 150, which remains fixed.

For example, the tubes 128*a*, 128*b* have an over-abundant length or are made of extensible (e.g., flexible) material. For example, the tubes 128*a*, 128*b* are made of flexible plastic, for example low-density polyethylene (LDPE) or polyvinyl chloride (PVC) and of a thickness and other characteristics so as to be flexible.

According to an embodiment, the first delivery duct 40*a* and the second delivery duct 40*b* may flow into a breakup unit 152 inside the dispensing head 20. Such a breakup unit may improve the resulting spray pattern emitted from dispensing opening 158, producing a desired finer spray, in which the droplets of spray are atomized.

For example, the nozzle 150 may comprises a breakup unit 152 disposed therein, into which the delivery ducts 40*a*, 40*b* enter (particularly end sections 126*a*, 126*b* of ducts 40*a*, 40*b*).

For example, the breakup unit 152 may be formed in a nozzle body 154 applied to the frame 22, to which are sealingly applied the two flexible tubes 128*a*, 128*b*.

Additionally, the nozzle assembly 150 may comprise a nozzle mask having a dispensing opening 158 in communication with the breakup unit 152, administered in a manner rotatable by a user to the nozzle body 154, for example in order to close the dispensing opening 158 by rotation.

According to further variant embodiments, the delivery ducts 40*a*, 40*b* may each comprise a respective dispensing opening for the substantially simultaneous and separate dispensing of the two substances to the outside. Such a configuration may be advantageous in preventing mixed composition from accumulating within the dispensing head, as efficacy of the composition may depend on it being "freshly" mixed. For example, an exemplary two-part bleach composition may lose efficacy about 2 minutes after mixing.

Furthermore, the dispensing head 20 may preferably comprise removable locking means suitable to prevent accidental actuation of the trigger 90. For example, as seen in FIGS. 6, 7, and 9*a*-9*c*, the locking means may comprise a removable latch 160, suitable to be placed between the frame 22 and the trigger 90 to prevent the actuation of the trigger 90. For example, the latch 160 may be hinged to the frame 22 at a latch hinging point 162 and may present an anchoring portion 164 suitable to couple itself to a protrusion 166 of the frame 22. Preferably, the latch 160 and the trigger 90 can be snap-coupled to each other. In a locked configuration, the latch 160 may be in an angular position in which it obstructs the actuation of the trigger 90 and the anchoring portion 164 is coupled to the protrusion 166 of the frame, so that the latch 160 stably maintains the position.

Figure 9C:
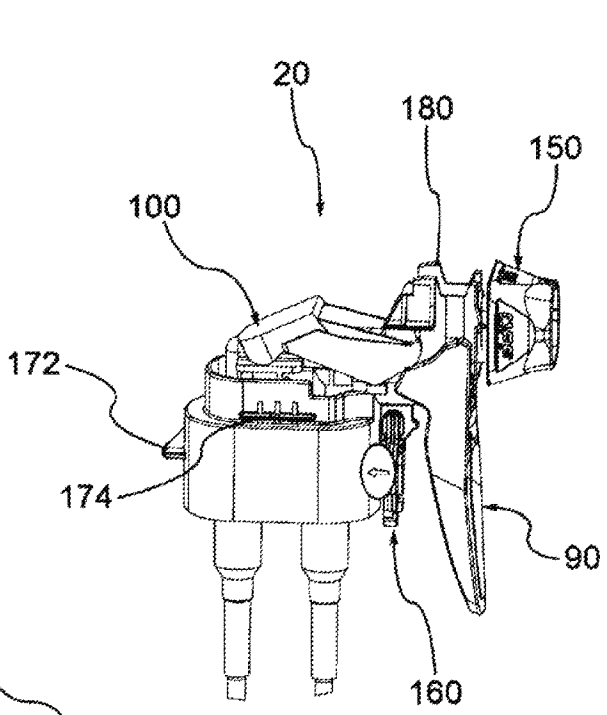
FIGS. 9*a* to 9*c* show the dispensing head in a locked configuration (FIG. 9*a*), an unlocked and partially actuated configuration (FIG. 9*b*), and in a fully actuated configuration (FIG. 9*c*), respectively.
Figure 9B:
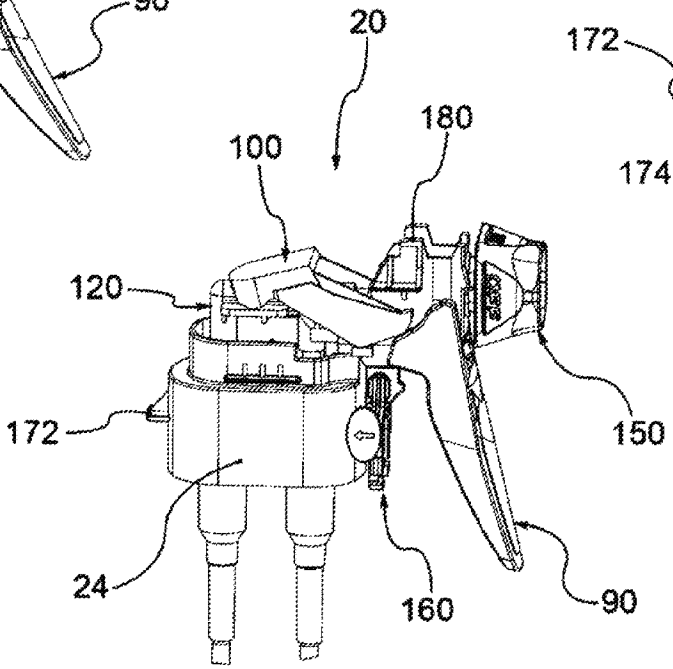
Figure 9A:
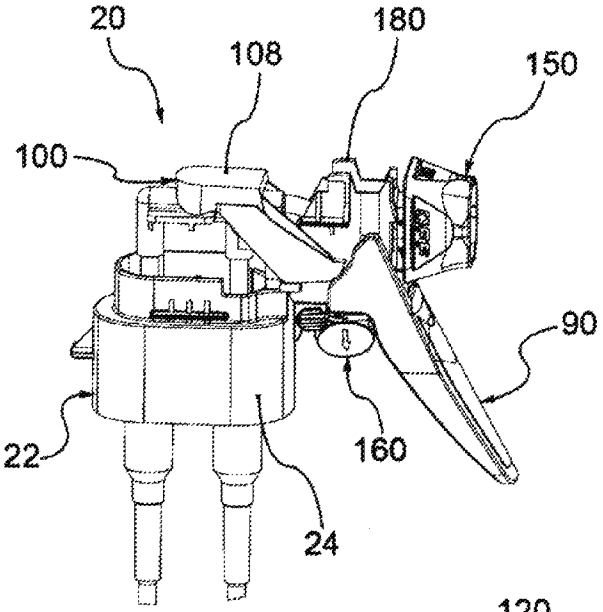
Figure 10:
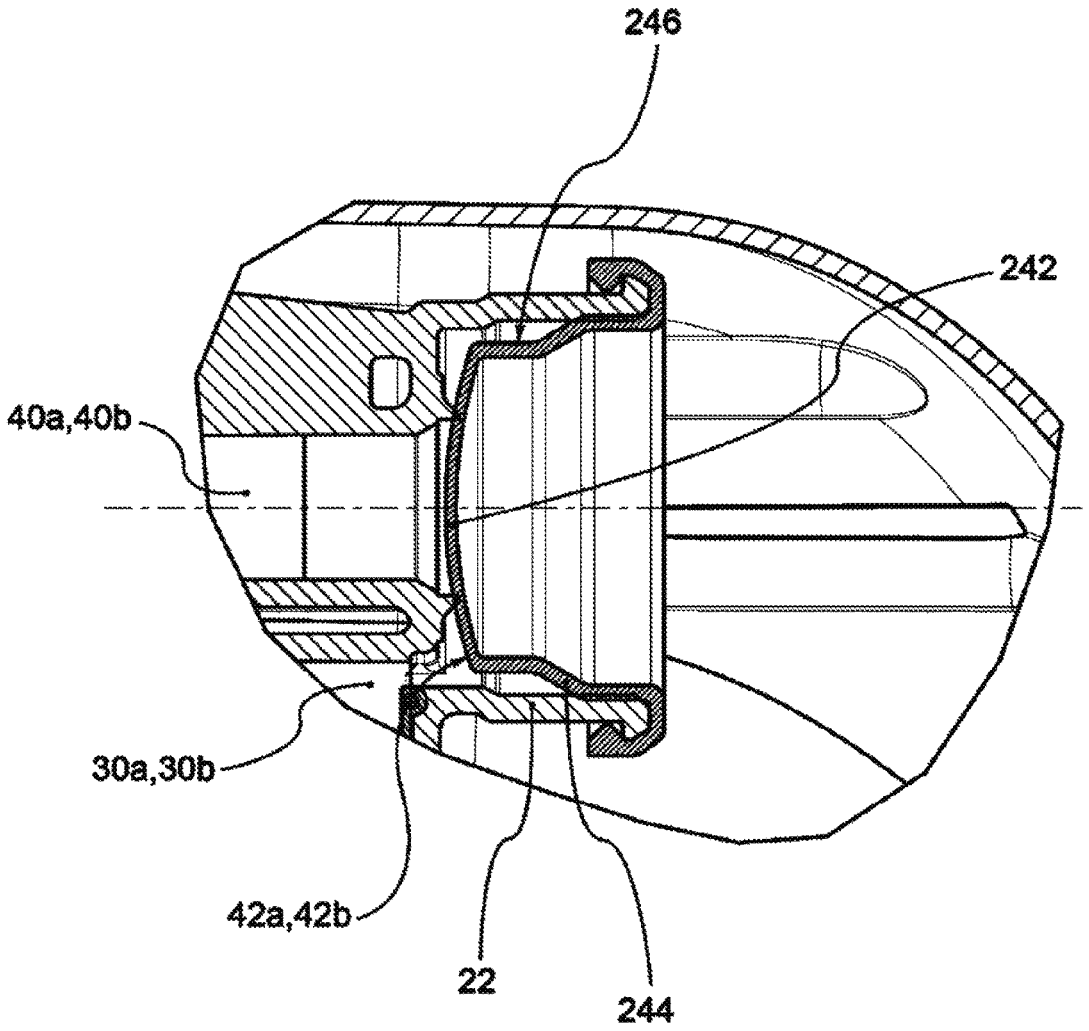
FIG. 10 shows a pre-compression valve of the dispensing head according to a further embodiment of the invention.
Figure 11:
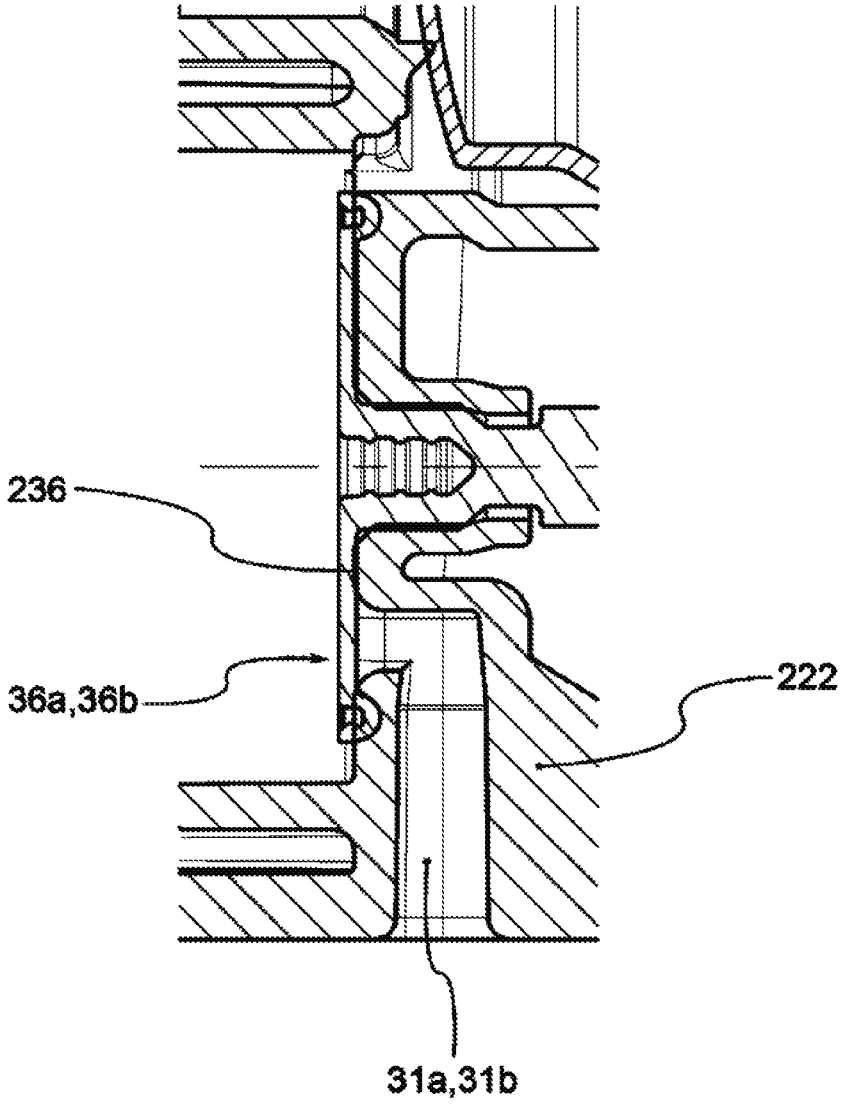
FIG. 11 shows a pre-compression valve of the dispensing head according to a further embodiment of the invention.

FIGS. 9*a*-9*c* illustrate both locked and unlocked positions. For rotation by a user, the anchoring portion 164 disengages from the protrusion 166 (and preferably the latch 160 and the trigger 90 release their mutual snap coupling) and the latch 160 is brought into an angular position in which it does not obstruct the actuation of the trigger 90 (FIG. 9*b*).

The dispensing head 20 may further comprise a cover 170, snap-coupleable to the frame 22. In particular, the frame 22 may comprise a rear fin 172, projecting externally from the coupling head wall 24 on the part opposite the trigger 90, side fins 174, projecting from one side and the other of the frame 22, above the coupling head wall 24 (see FIG. 4), and front side fins 178 and 180, projecting from one side and the other of the frame 22 in the vicinity of the nozzle assembly 150, all snap-coupled with the cover 170.

Innovatively, the device according to the present invention meets the needs of the field, since it achieves an excellent mixing of the two substances thanks to the separate and substantially simultaneous compression of both substances immediately before being combined with each other.

In other words, the pre-compression of the two substances prior to their combination, makes the mixing particularly effective, both in the event that it takes place inside the device, and when it takes place on the object to be treated, for example a surface to be cleaned (e.g., sanitized, disinfected, sterilized, or otherwise treated).

Advantageously, moreover, the assembly of the device is particularly fast and efficient, thanks to the snap connection between the head and the bottle. This advantage is especially appreciated in the field, given the enormous volume of production. The dispensing head may snap onto the bottle, so as to not be removable therefrom (e.g., configured for use of one fill-volume, rather than repeated refilling).

According to a further advantageous aspect, the device is very reliable, thanks to the robust mechanism which ensures the actuation of the pistons in response to the actuation of the trigger.

Advantageously, moreover, the application of the dispensing head to the bottle is particularly fast, to the advantage of high-volume production.

According to further embodiments, the check valves comprise a flexible membrane deformable by the action of the pressure in the pressure chamber.

For example, according to an embodiment (FIG. 11), the check valve 36*a*, 36*b* comprises a flexible membrane 236, affixed to the frame 222.

According to further embodiments, the pre-compression valve comprises a flexible membrane deformable by the action of the threshold pressure in the pressure chamber.

For example, the pre-compression valve 42*a*, 42*b* may be made in a single piece, for example in plastic, and may comprise a deformable membrane 242 (see FIG. 10), for example of a convex shape towards the respective delivery duct 40*a*, 40*b*, and a sleeve 244 for positioning in a valve seat 246 of the frame 22.

For example, the sleeve 244 is coupled to the frame 22. According to a variant embodiment, the pre-compression valve means may comprise a latch member applicable to the frame to clamp the sleeve to the frame.

Any of the features and structures shown or described in the context of fluid dispensing device shown in FIG. 1-11 may be included within any of the alternative embodiments described in some detail below. Not all features of each of the below described embodiments are described in detail, particularly where such features and structures will be appreciated to be similar to those already described. Similarly, any features described in conjunction with the embodiments described below may be incorporated into the previous described embodiment (or any other embodiment).

Figure 12:
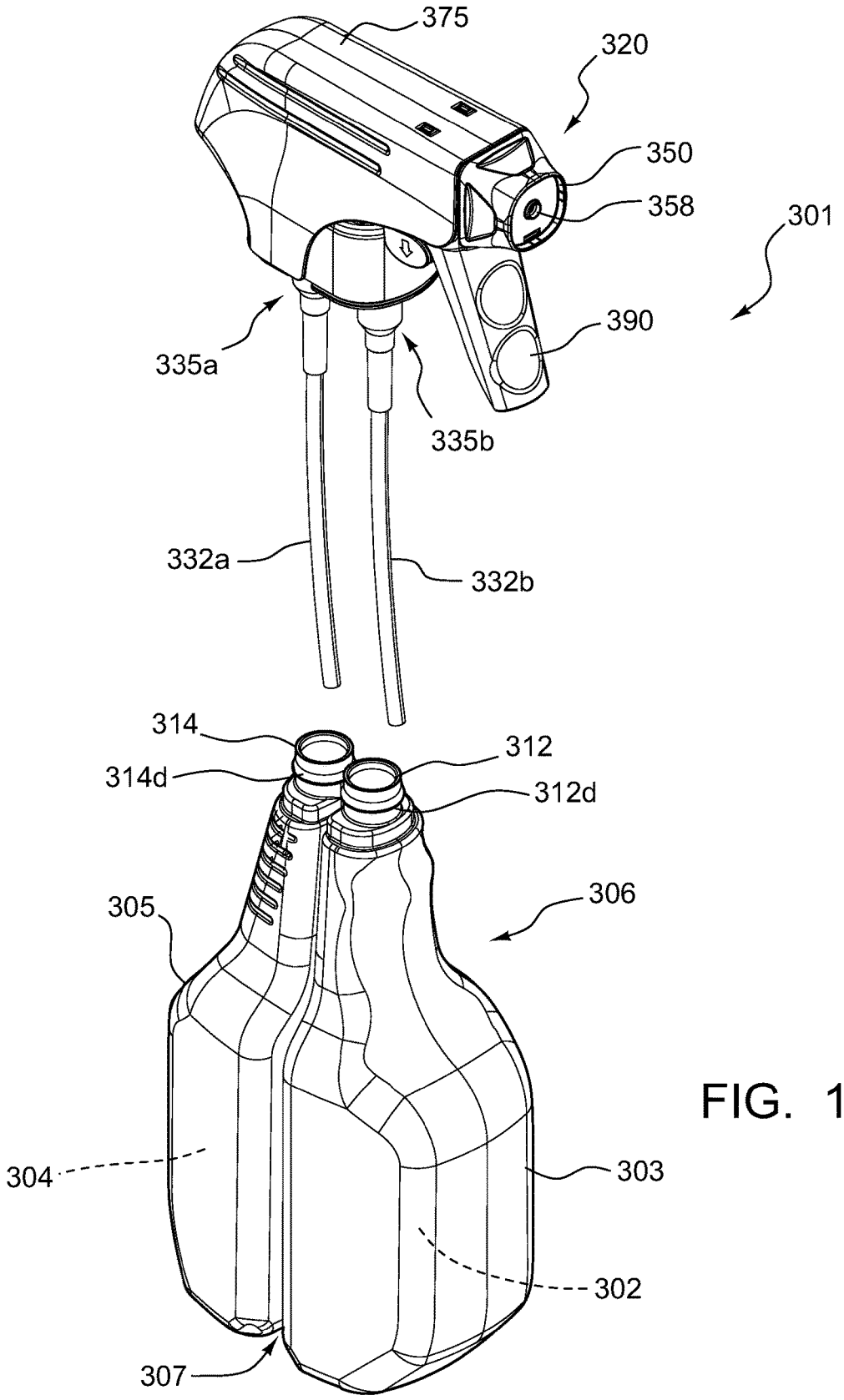
FIG. 12 shows a perspective view of a trigger-actuated fluid dispensing device according to another example embodiment of the present invention, exploded from its associated dual compartment bottle.
Figure 13:
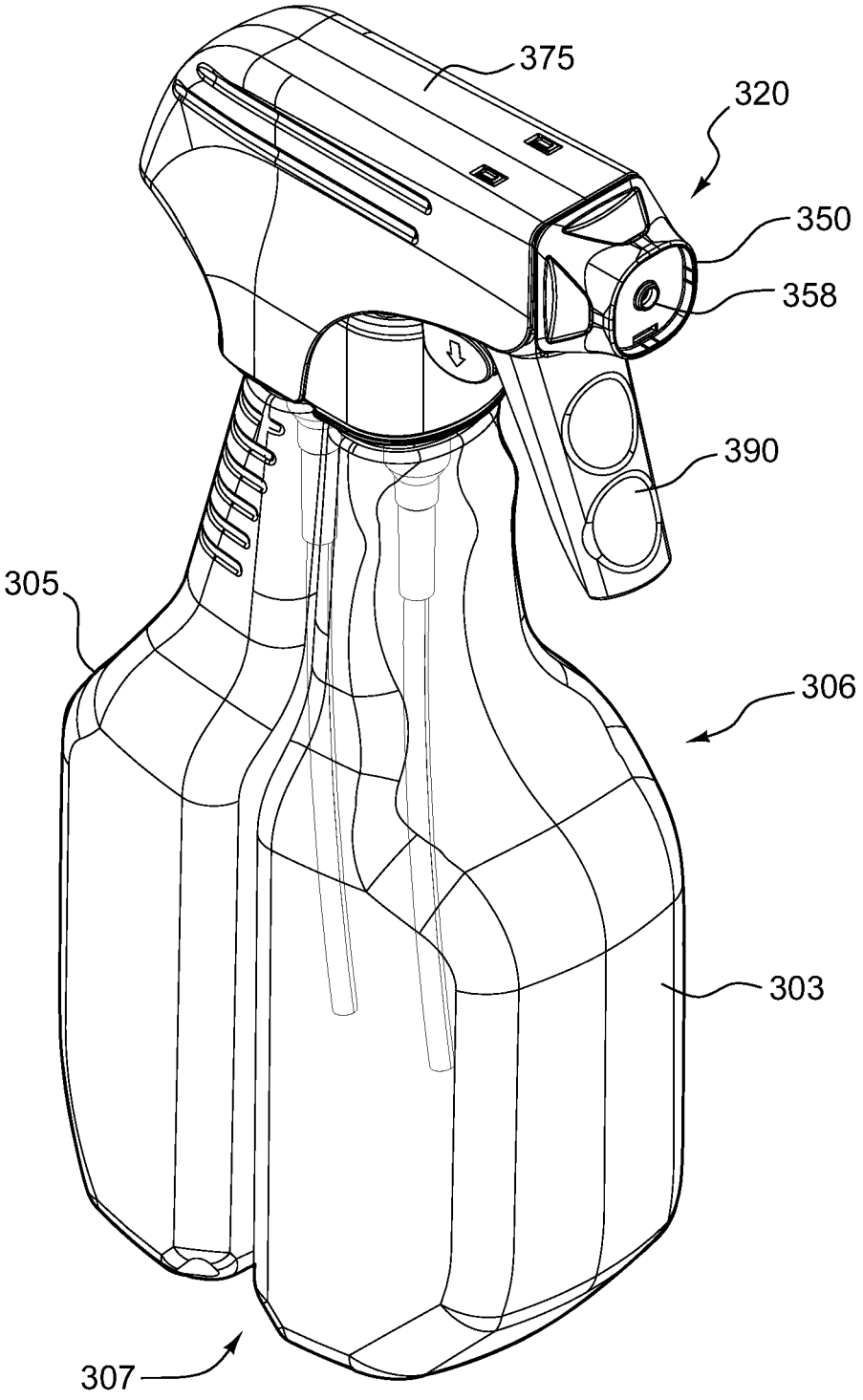
FIG. 13 shows the fluid dispensing device of FIG. 12, attached to the dual compartment bottle.

FIGS. 12-16 illustrate another exemplary fluid dispensing device 301, which may be quite similar to dispensing device 1 and dispensing head 20 of FIGS. 1-11. In particular, device 301 is shown as including two flexible delivery tubes 328*a* and 328*b* (see FIG. 14). As shown in FIG. 12, dispensing device 301 may include a bottle 306 including two compartments 302 and 304. Bottle 306 may include a front side 303, a back side 305, and a bottom 307. Two necks 312 and 314 are provided on bottle 306, each with coupling fins 312*d* and 314*d*, or other bottle coupling portion. Each compartment 302, 304 may accommodate a desired volume, e.g., from about 10 to about 20 fl. ounces each (e.g., about 16 fl. ounces each). It will be apparent that compartments 302 and 304 are not in fluid communication with one another. Although not shown, it will be appreciated that a wrap may be positioned around bottle 306 (e.g., further coupling the two portions shown together).

As seen in FIG. 12, in addition to the bottle 306, the dispensing device 301 further includes a dispensing head 320. Dispensing head 320 may include a frame 322 (FIG. 14), a trigger 390, first and second pumps 335*a*, 335*b*, a cover 375, and other structures similar to head 20 as described above. Pumps 335*a*, 335*b* may be similarly configured as those shown above (e.g., including springs 350*a*, 350*b*, obturators 338*a*, 338*b*, piston heads 346*a*, 346*b*, springs 348*a*, 348*b*, flange 370, piston rods 337*a*, 337*b*, e.g., where pumps 335*a*, 335*b* and their associated components are housed within casings 360*a*, 360*b*. First and second dip tubes 332*a* and 332*b* may provide fluid communication between the interior volume of the respective compartments (302 and 304) of bottle 306, into pumps 335*a* and 335*b*.

A nozzle assembly 350 may be provided, which fluidly communicates with first and second delivery tubes 328*a* and 328*b*, so that the liquids may pass up from dip tubes 332*a*, 332*b*, into pumps 335*a*, 335*b*, exiting the pumps through piston rods 337*a* and 337*b*, and entering into intermediate body 320*a*, from which the separate liquids are introduced into separate delivery tubes 328*a*, 328*b*. Mixing of the two parts of the dispensed composition may occur for the first time within nozzle assembly 350. For example, nozzle 350 may include a breakup unit 352 within mixing nozzle body 354, just upstream from where the mixed composition exits through dispensing opening 358. In other embodiments, a breakup unit may be omitted, so that mixing may be achieved only upon reaching dispensing opening 358 (or upon being sprayed therefrom onto a surface—e.g., two dispensing openings could be provided). If desired, a check valve or similar structure for preventing back flow from breakup unit 352 could be provided. Breakup unit 352 may improve the resulting spray pattern emitted from dispensing opening 358, producing a desired finer spray, in which the droplets of spray are atomized.

In an embodiment, the volume of mixed composition present within the dispensing device 301 may be particularly small, e.g., where mixing does not occur until breakup unit 352 is reached. For example, the first and second fluids may be maintained separately up to such point, so that the dispensing device 301 may include no more than about 0.2 mL of mixed first and second fluids at any given time. Where a single trigger actuation is sufficient to dispense about 1 mL of each of the first and second liquids or other fluids (e.g., about 2 mL of mixed composition), it will be apparent that such a volume represents only a small fraction of a single "spray" (e.g., no more than 10%).

Such characteristics aid in preventing or minimizing the presence of residual mixed composition that may remain within the dispensing head, e.g., as a user finishes use in one room or area, and moves to another, finishes using the dispensing device for a day or shift, or the like. Under such circumstances, it may be more than a few minutes before the same or a different user again actuates the trigger to dispense another spray of the two-part composition. Under such circumstances, any residual mixed composition is so small in volume as to not significantly alter the efficacy of the sprayed mixed composition (as it is overwhelmingly diluted in the first spray after such prior use).

Figure 14:
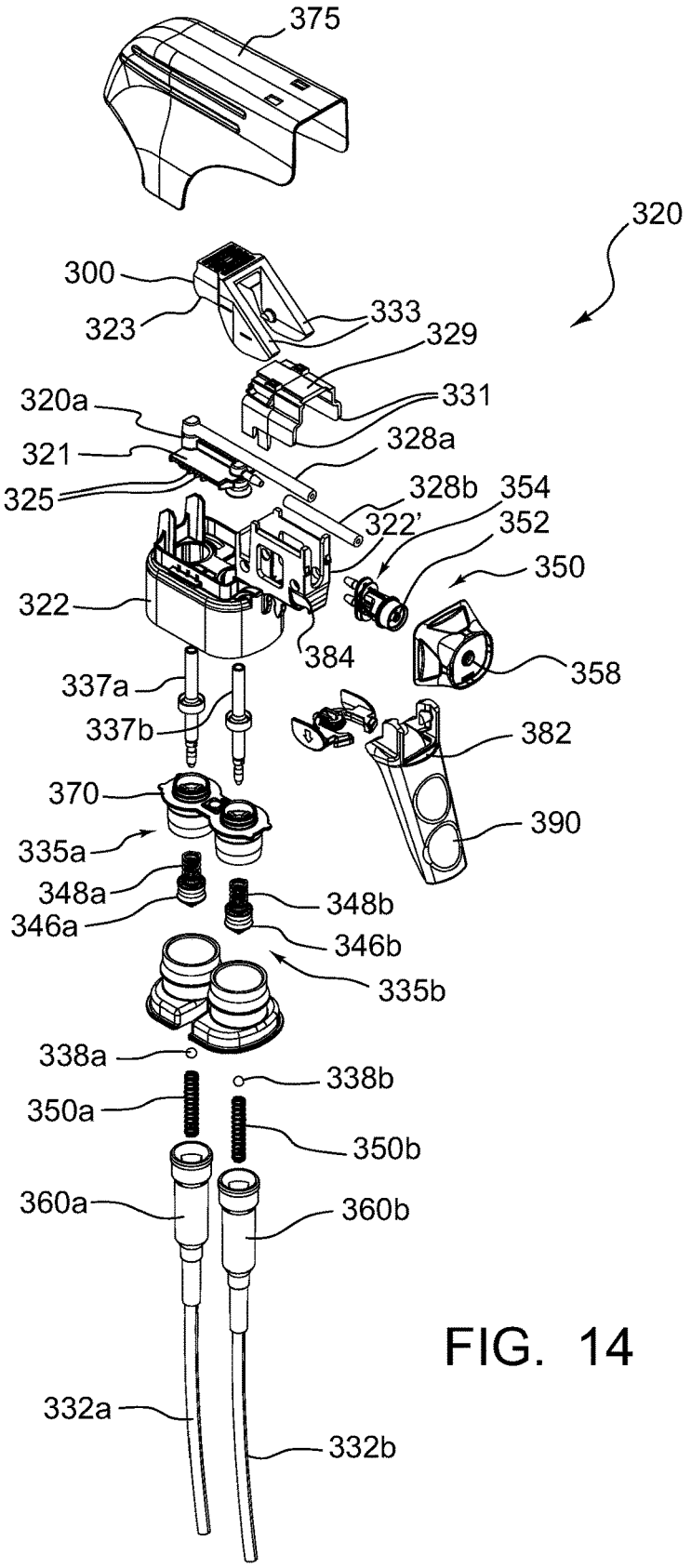
FIG. 14 shows an exploded view of the dispensing head of the device of FIG. 12.
Figure 15A:
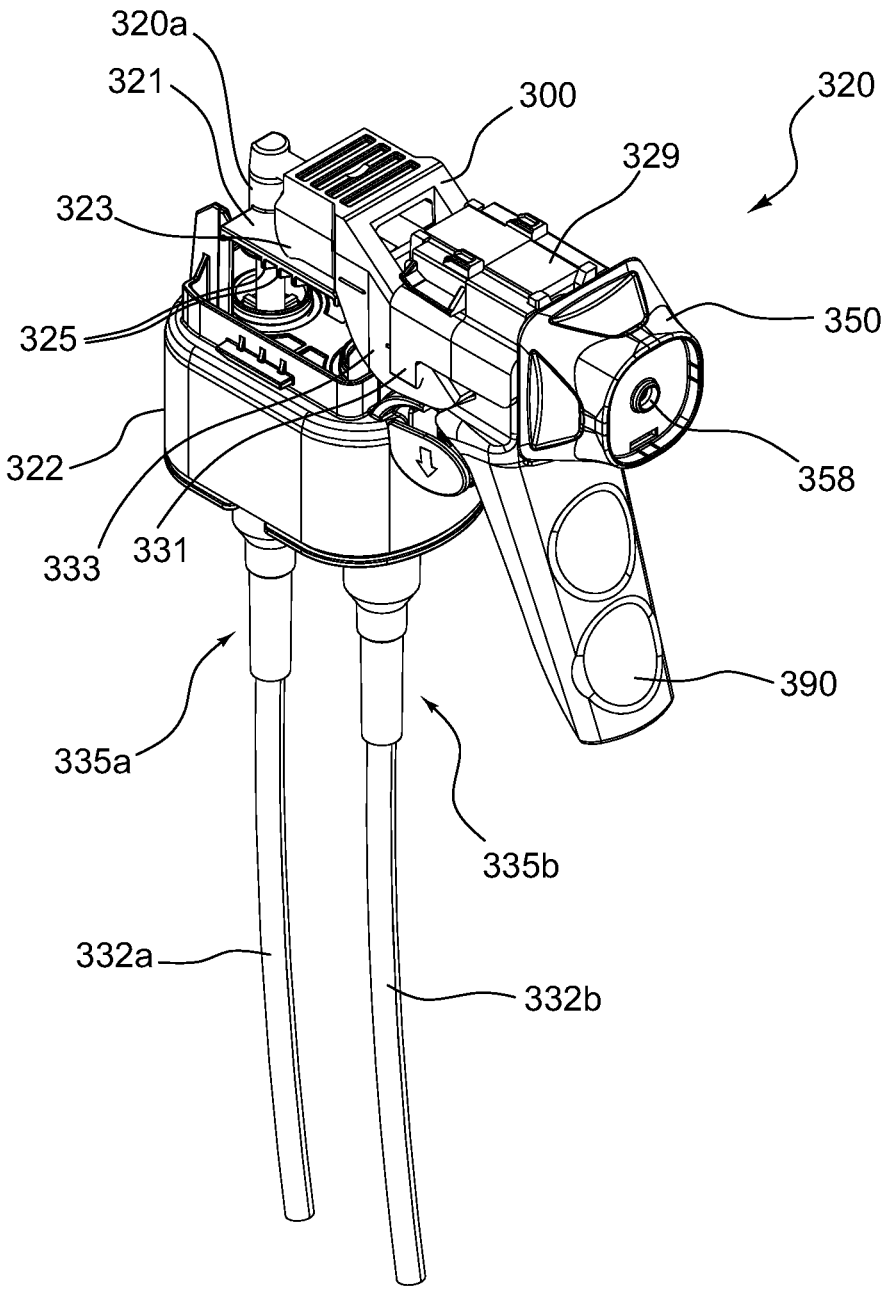
FIG. 15A shows the dispensing head of the device of FIG. 14, without the cover, from a front perspective.
Figure 15B:
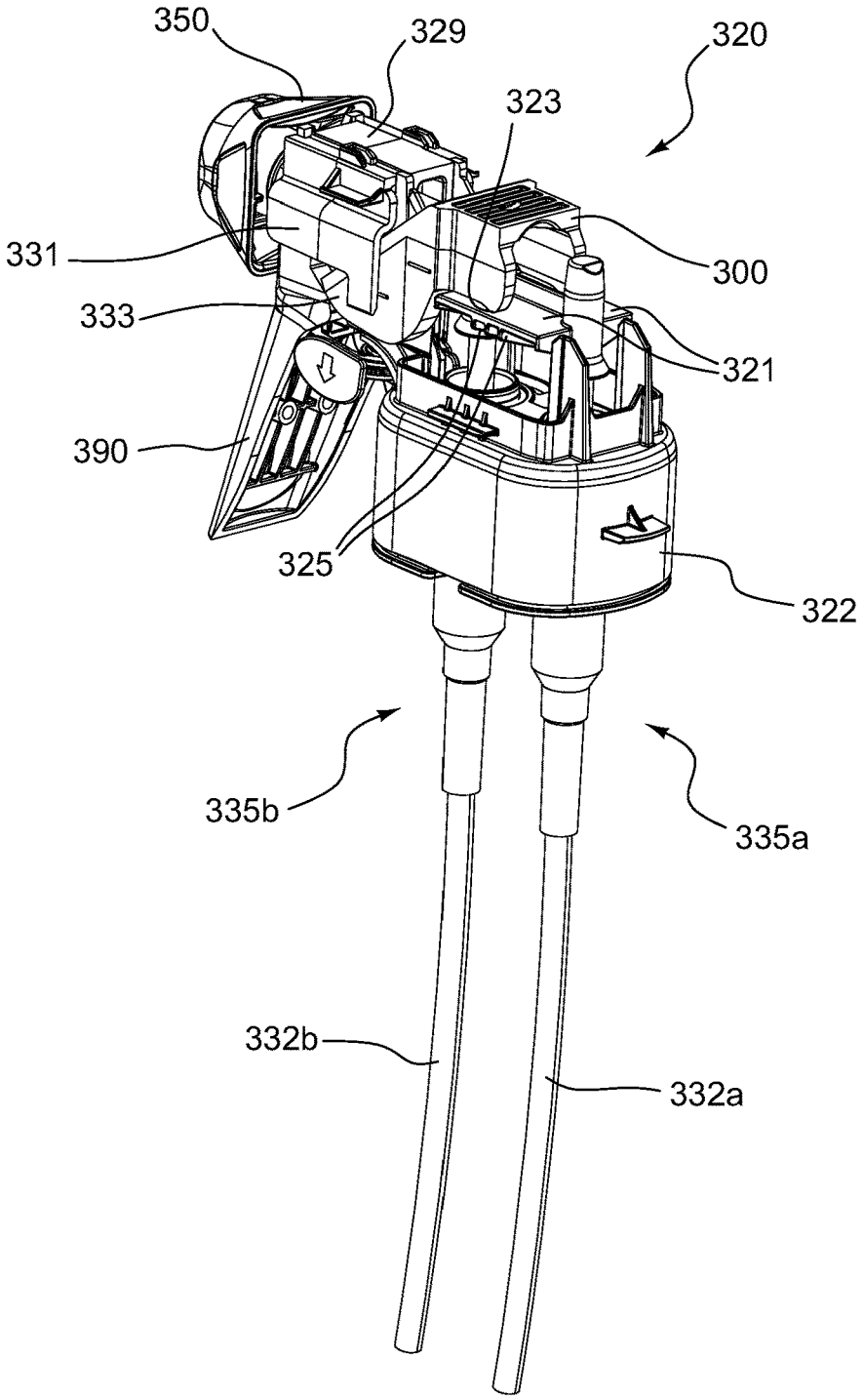
FIG. 15B shows the dispensing head of the device of FIG. 14, without the cover, from a rear perspective.
Figure 15C:
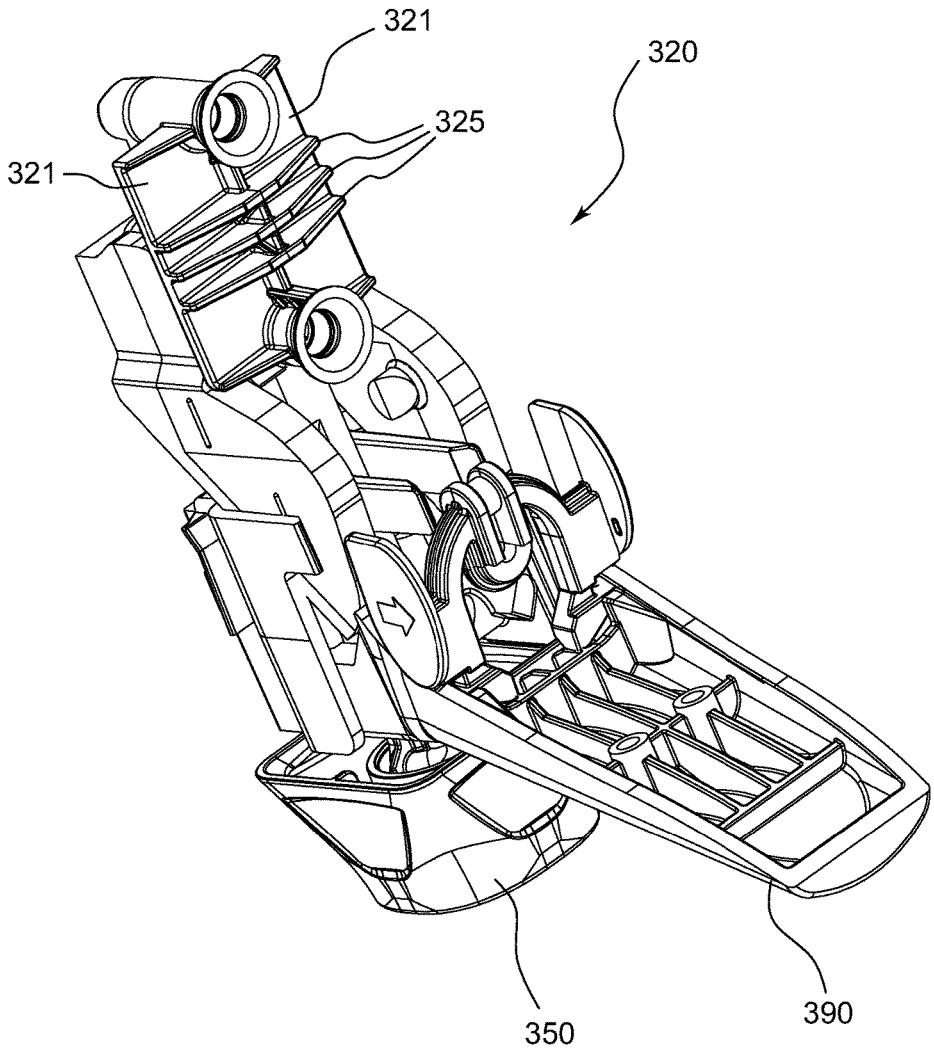
FIG. 15C shows a close-up of the underside of the intermediate body 320*a* of the dispensing head seen in FIG. 15B, to better show reinforcing support ribs 325.

As shown in FIG. 14, dispensing head 320 may further include a transmission member 300 and intermediate body 320*a* including flanges 321, which are pressed downward upon counter-rotation of transmission member 300 in response to actuation of trigger 390, substantially simultaneously actuating both pumps 335*a* and 335*b*, as explained above relative to dispensing head 20. Flanges 321 may be configured as substantially horizontal platforms, and may include one or more reinforcing support ribs 325 disposed on the bottom surface of such platform, as perhaps best seen in FIG. 15C. Reinforcing support ribs can also be seen in FIGS. 14, 15A, and 15B. As seen in FIGS. 15A-15C, the ribs 325 may be disposed aligned below the location on flange 321 where protrusion 323 contacts flange 321 as it presses vertically downward on flange 321. Placement of such ribs or other reinforcing structure at this location results in more efficient transfer of the applied downward, activating force, minimizing or eliminating bending of intermediate body 320*a* along flanges 321.

Returning to FIG. 14, dispensing head 320 may further include a bridge member 329. Bridge member 329 may span a front portion 322' of frame 322, which may aid in strengthening and supporting the front portion 322' of frame 322. FIGS. 15A and 15B further show bridge member 329 in position, over the front portion 322' of frame 322. As seen, the vertical arms 331 of bridge member 329 may also span across the arms 333 of transmission member 300.

The force required to actuate trigger 390 (or any of the dispensing heads disclosed herein) may be less than about 15 lbs of force (e.g., from about 9 lbs to less than 15 lbs). The trigger 390 may include a reinforcing mechanism that reduces risk of breakage of the trigger when the trigger is pressed backwards. For example, in commercial or professional use environments, a spray dispenser such as that described herein may often be hung off the side of a cleaning cart. While very prevalent and convenient, such hanging typically applies a rearward force to the trigger, opposite the normal actuating force, which can sometimes lead to breakage of the trigger mechanism. The dispensing device may include a top portion 382 of trigger 390 which contacts a reinforcing flange 384 on frame 322, which prevents hyper-extension reverse actuation of trigger 390. Such is perhaps best seen in the exploded view of FIG. 14 and the cross-sectional view of FIG. 16. Such reinforcement to reduce risk of breakage of the trigger mechanism may allow the back-side or bottom portion of the trigger 390 to be used as a single point of contact to support the device (e.g., as hung from a cart or similar), with little risk of breakage. Such may provide at least 12 lbs of force (e.g., at least 13, at least 14, or at least 15 lbs), before breakage of the trigger mechanism.

As described above relative to dispensing head 20, pumps 335*a* and 335*b* may be configured to deliver substantially the same volume of the first and second liquids or other fluids, respectively, to the nozzle 350, substantially simultaneously, to allow the dispensing container to aspirate an approximately 1:1 mixture of the first and second parts of the mixed composition. The 1:1 ratio is achieved, even though as shown, the dip tubes 332*a*, 332*b* may be aligned with one another front to back, with one dip tube 332*b* in front of dip tube 332*a*, and where the length of the delivery tubes 328*a* and 328*b* may thus differ (with liquid delivered through rear tube 328*a* having to travel farther than liquid delivered through front tube 328*b*). As shown in the cross-sectional view of FIG. 16, the first and second delivery tubes 328*a* and 328*b* may be arranged with one above the other, e.g., in the same vertical plane). Under some circumstances, small variations within the 1:1 ratio may be acceptable, e.g., within 10%, 5%, 3%, or 1% of the target 1:1 ratio.

Of course, it will be appreciated that where desired, a different ratio of the two fluids may be provided (e.g., intentionally providing more of one fluid than the other). For example, pumps configured to provide different capacities, and/or the presence of a flow regulator in one of the lines, or the like, may be employed if it is desired to provide a different volumetric delivery ratio. Where such is desired, it will be appreciated that the size of the two compartments of bottle 306 may differ from one another.

The spray pattern provided by any of the dispensing heads described herein may provide a sprayed footprint of mixed composition that is about 8 to about 10 inches in diameter, from a typical spraying distance (e.g., from about 3 inches to about 30 inches). Of course, relatively closer spray distance may reduce the sprayed footprint as compared to a further spray distance.

FIGS. 1-16 show embodiments of dispensing devices that include dual, separate delivery tubes, so that mixing does not occur upstream from the breakup unit of the nozzle assembly being reached (and could occur even after the nozzle, depending on specific configuration). FIGS. 17-26E illustrate alternative configurations that provide for mixing of the two liquids to occur earlier within the dispensing head.

Figure 21:
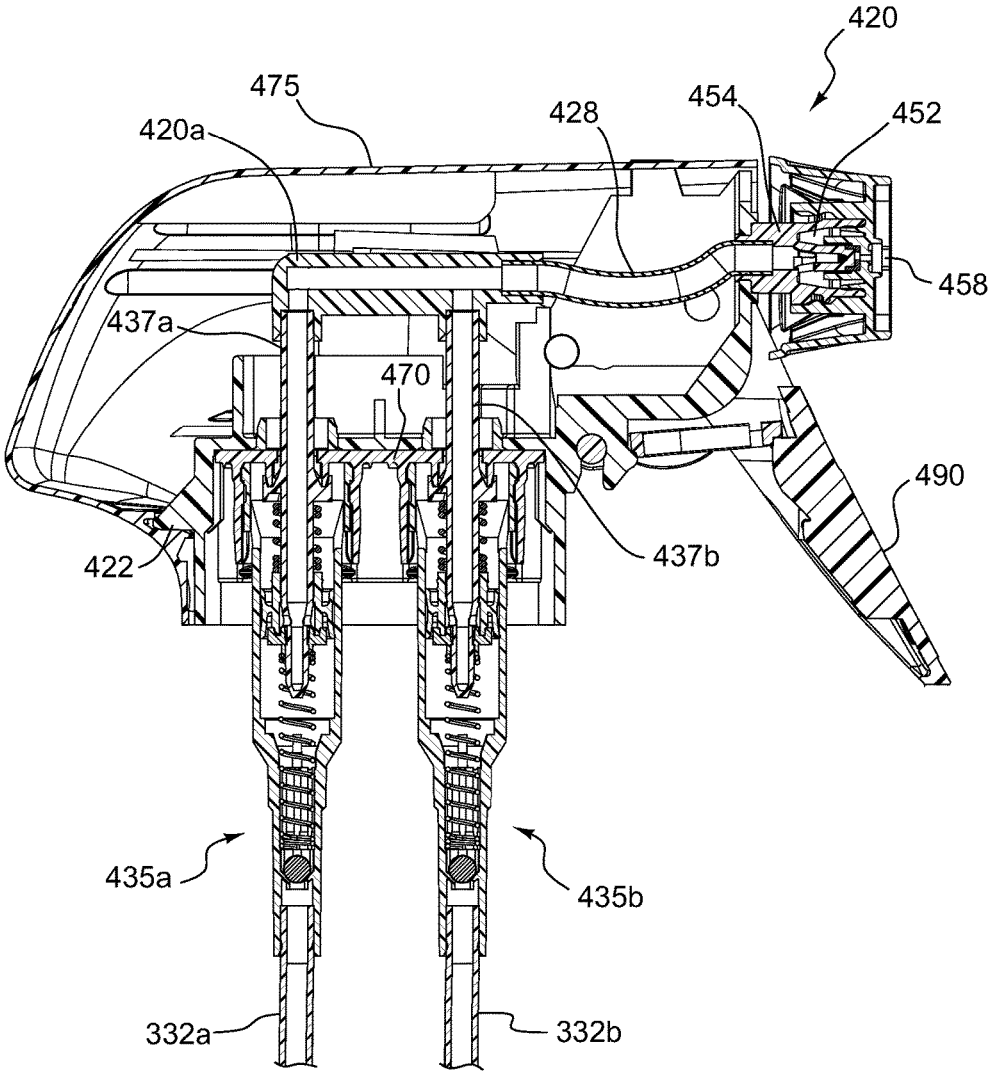
FIG. 21 shows a cross-sectional view through the dispensing head of the device of FIG. 17.
Figure 22:
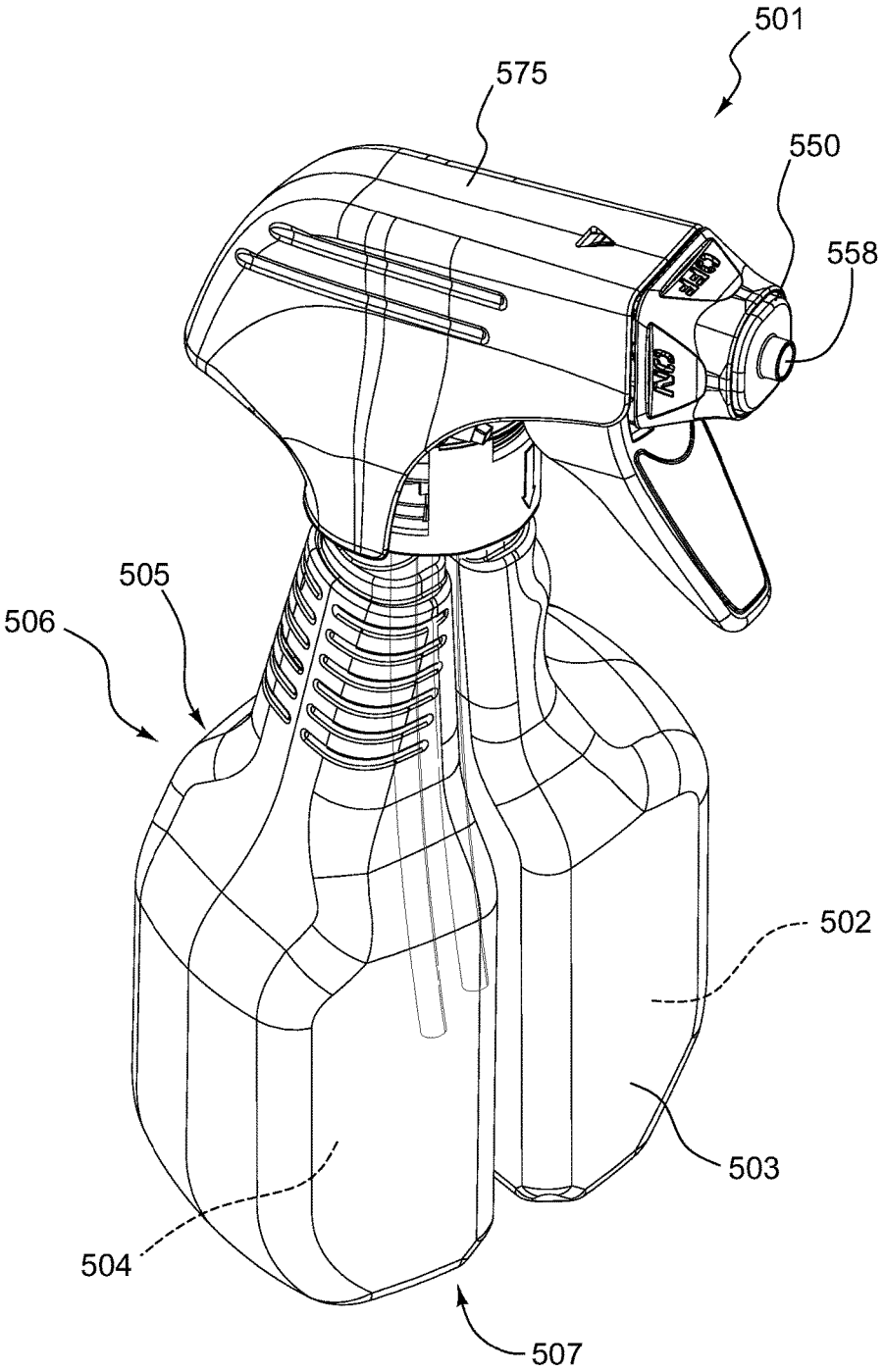
FIG. 22 shows a perspective view of another fluid dispensing device according to the present invention, attached to its associated dual compartment bottle.

FIGS. 17-21 show a dispensing device 401 similar to dispensing device 301, but in which only a single delivery tube 428 is provided, e.g., attached between intermediate body 420*a* and nozzle body 454 of nozzle assembly 450. Such a device 401 may include many similar components as the other dispensing devices described herein, e.g., a bottle 406 including a first compartment 402 and a second compartment 404 may be provided, with necks 412 and 414. As described above, each neck 412, 414 may include a bottle coupling portion (e.g., one or more coupling fins) to allow dispensing head 420 to snap or otherwise couple onto bottle 406. Bottle 406 may include a front side 403, a back side 405, and a bottom 407. The exterior appearance of dispensing head 420 may be similar, or even identical to dispensing head 320. For example, dispensing head 420 is shown as including first and second dip tubes 432*a*, 432*b*, arranged in front to back alignment, with first and second pumps 435*a*, 435*b* in fluid communication with the respective dip tubes. A trigger 490, cover 475, nozzle 450, and nozzle dispensing opening 458 are also shown. The exploded view of FIG. 19 and the cross-sectional view of FIG. 21 show various similar internal components, e.g., connecting flange 470 bridges the casings associated with the two pumps 435*a*, 435*b*, to aid in simultaneous connection to the frame 422, and substantially simultaneous actuation of the two pumps 435*a*, 435*b* as transmission member 400 (protrusion 423) depresses on opposed flanges 421 of intermediate body 420*a* (which may include reinforcing rib(s) 425, as described above.

Rather than including two outlets, intermediate body 420*a* is shown as including a single outlet, attached to single delivery tube 428, which in turn is fluidly connected to nozzle body 454. As shown, such a single delivery tube 428 may be vertically aligned with pumps 435*a*, 435*b*, so as to be above the pumps. As seen, the tube 428 may run below the top of transmission member 400, with the engagement portions 433 (arms on either side of main portion 408), extending on either side of tube 428, so that portions 433 engage with trigger 490, in the counter-rotation rocking motion as described in reference to trigger 90, above.

Where only a single delivery tube 428 is provided, mixing of the two liquids or other composition components may occur upstream from breakup unit 452 in nozzle body 454, e.g., mixing may begin to occur within the single delivery tube 428. Homogeneity of mixing may be further achieved (e.g., homogenous mixing of the two fluids) within breakup unit 452, and/or when the mixture is deposited onto the surface being treated (e.g., countertop, table, wall, cart, instrument, etc. being cleaned).

Even where mixing may occur within a single delivery tube, the volume of mixed fluid present within such delivery tube may be relatively small, e.g., significantly less than the volume of mixture delivered by a single trigger actuation. For example, the volume of mixture delivered may be from about 0.5 mL to about 4 mL per trigger actuation, at an approximate 1:1 ratio of the two liquids. For example, in an embodiment, mixture volume delivered may be from about 1.8 mL to about 2.6 mL per trigger actuation (for example, 0.9 mL to 1.3 mL (i.e., about 1 mL) per pump, for about 2 mL total mixed volume delivered). The length and inside diameter of the single delivery tube 428 may be sufficiently short and small, respectively, so that any volume of residual mixed composition within the delivery tube, which may sit for some time after a period of use, may be no more than 50%, no more than 40%, no more than 30%, no more than 20%, or no more than 10% of the volume delivery associated with a single trigger actuation. For example, mixed fluid within the dispensing head may be no more than about 1 mL (e.g., 50% of 2 mL), no more than 0.6 mL (30% of 2 mL), or no more than 0.2 mL (e.g., 10% of 2 mL). As described above, including separate delivery tubes may reduce the volume of stored residual mixed composition that may be present within the dispensing head after a given use, and may thus be particularly useful in some circumstances. Such reduction can provide increased efficacy of the mixed composition provided by the first spray of a subsequent use (part of which includes emptying any residual mixture within the dispensing head).

Figure 16:
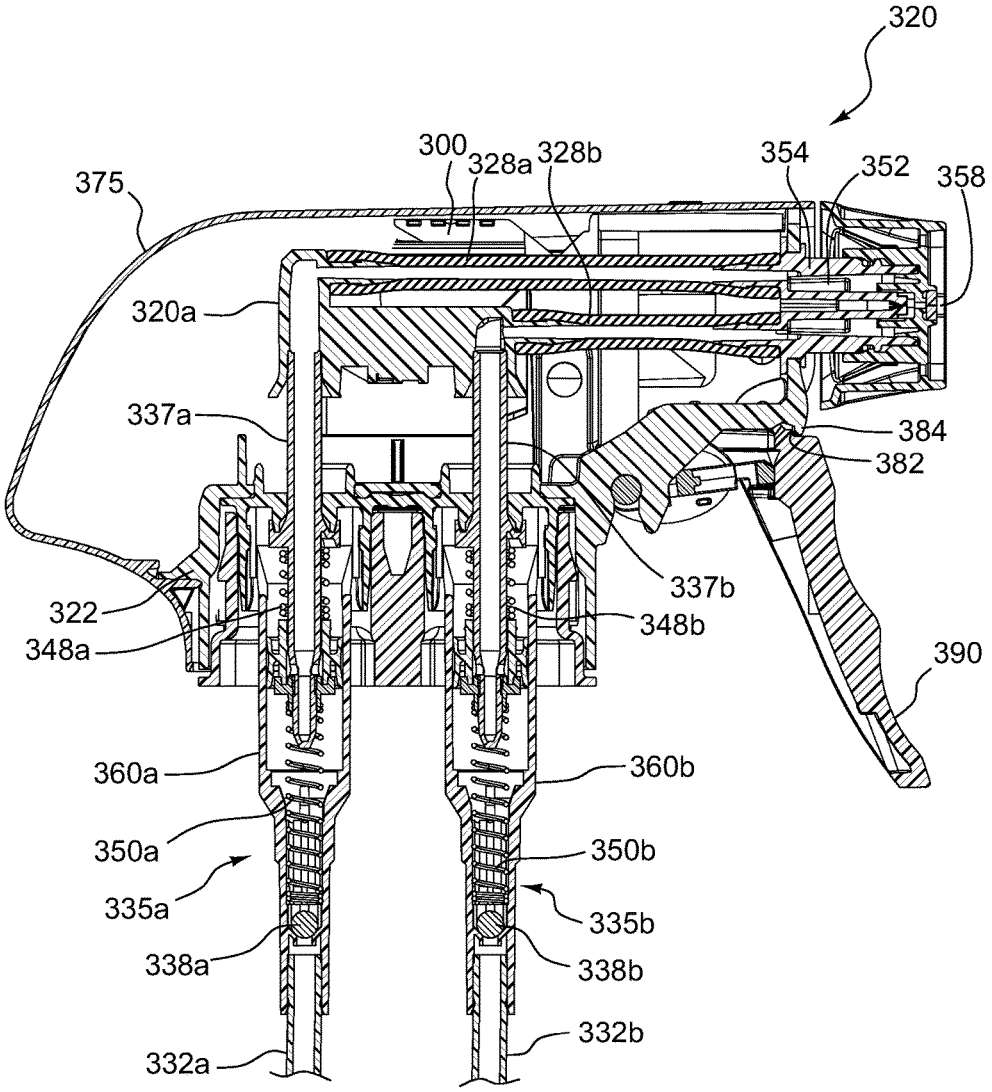
FIG. 16 shows a cross-sectional view through the dispensing head of the device of FIG. 12.
Figure 17:
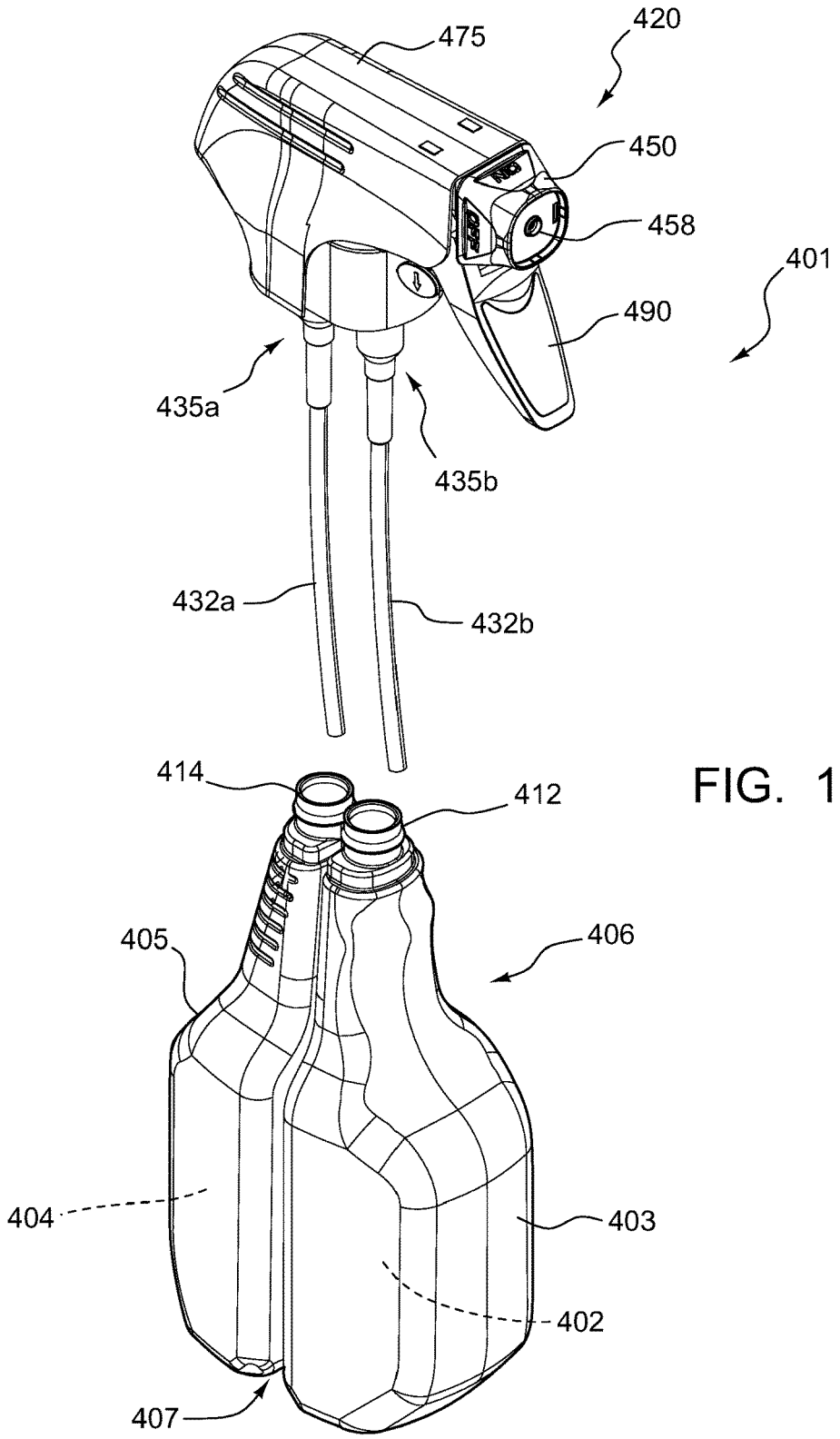
FIG. 17 shows a perspective view of another fluid dispensing device according to the present invention, exploded from its associated dual compartment bottle.
Figure 18:
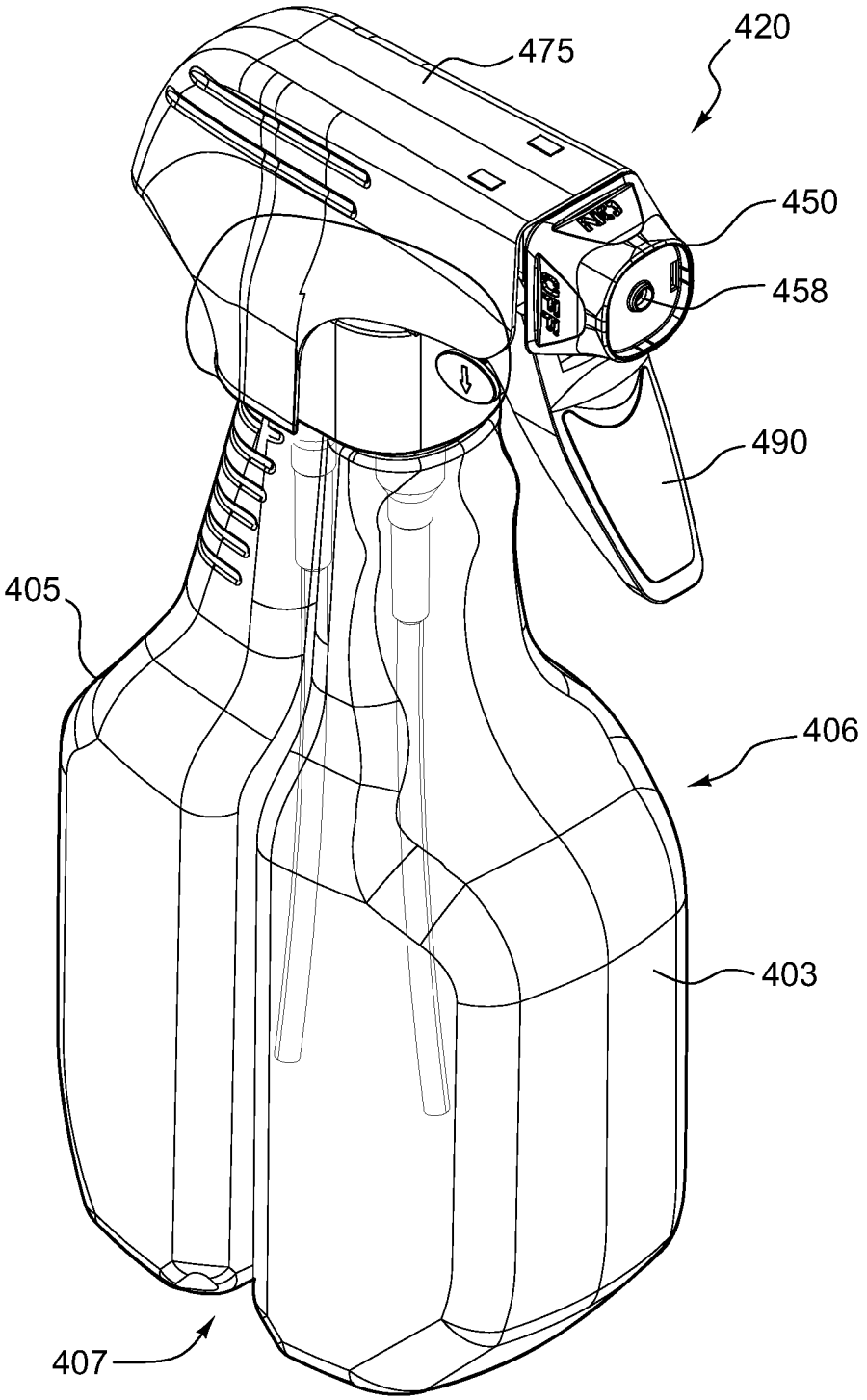
FIG. 18 shows the fluid dispensing device of FIG. 17, attached to the dual compartment bottle.
Figure 19:
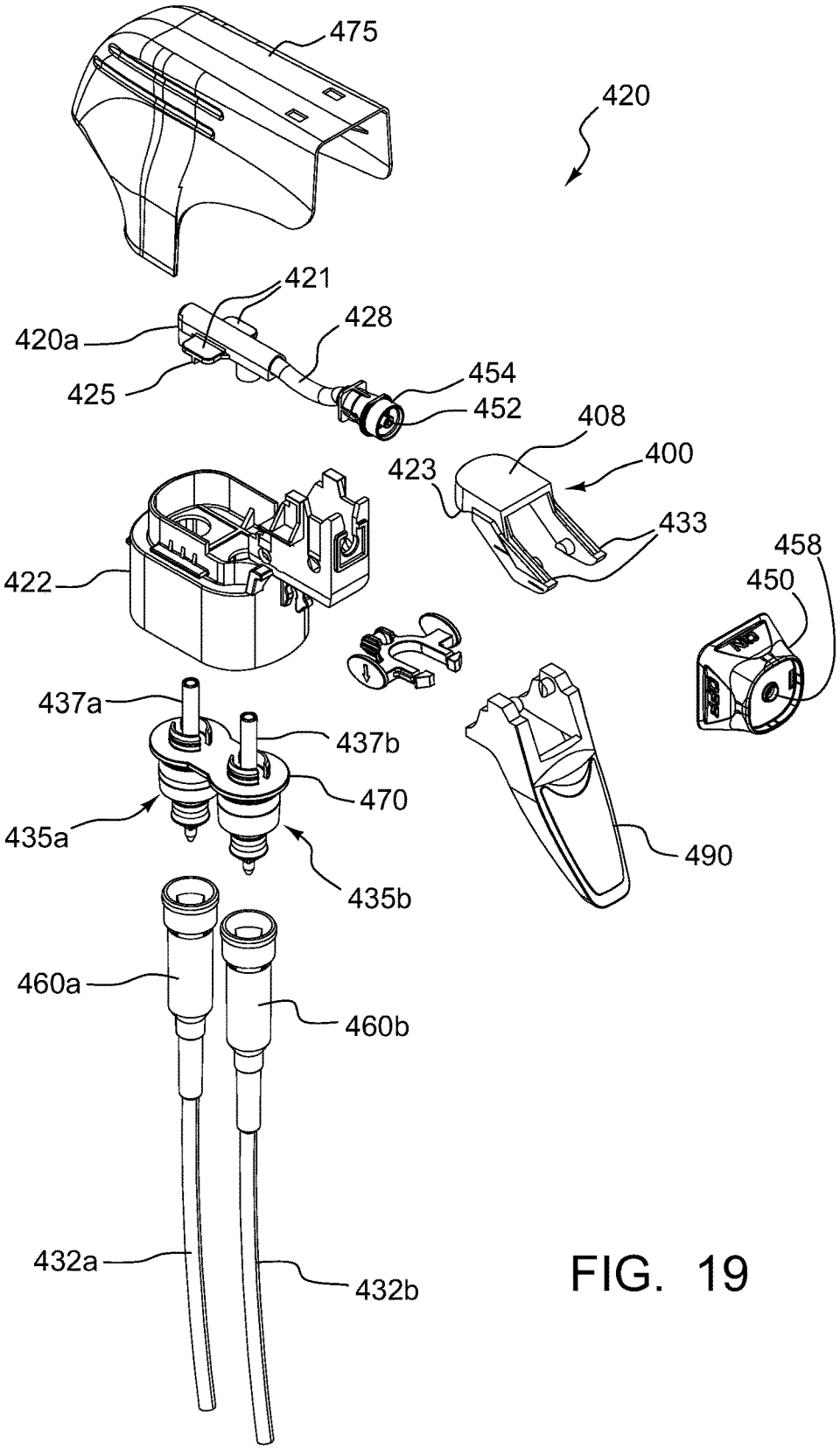
FIG. 19 shows an exploded view of the dispensing head of the device of FIG. 17.
Figure 20A:
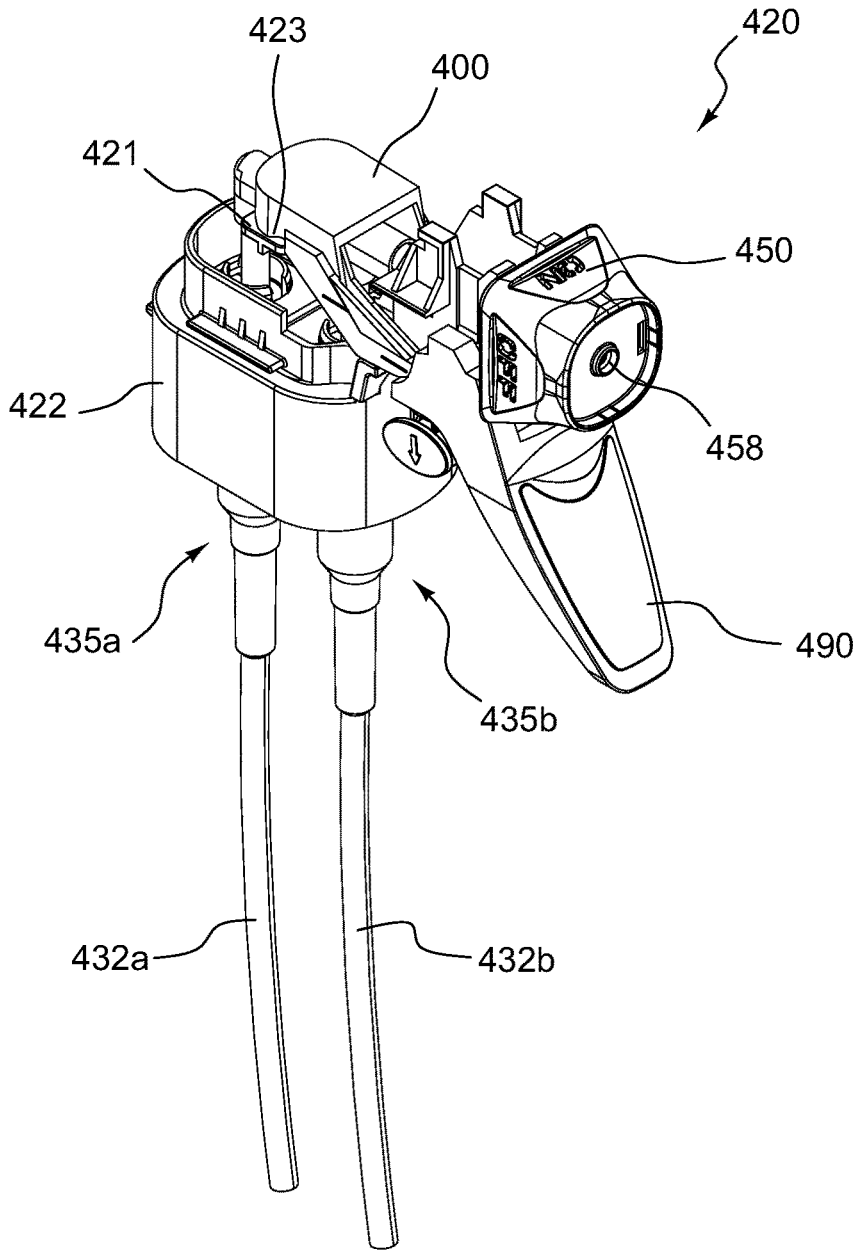
FIG. 20A shows a front perspective view of the dispensing head of the device of FIG. 17, without the cover.
Figure 20B:
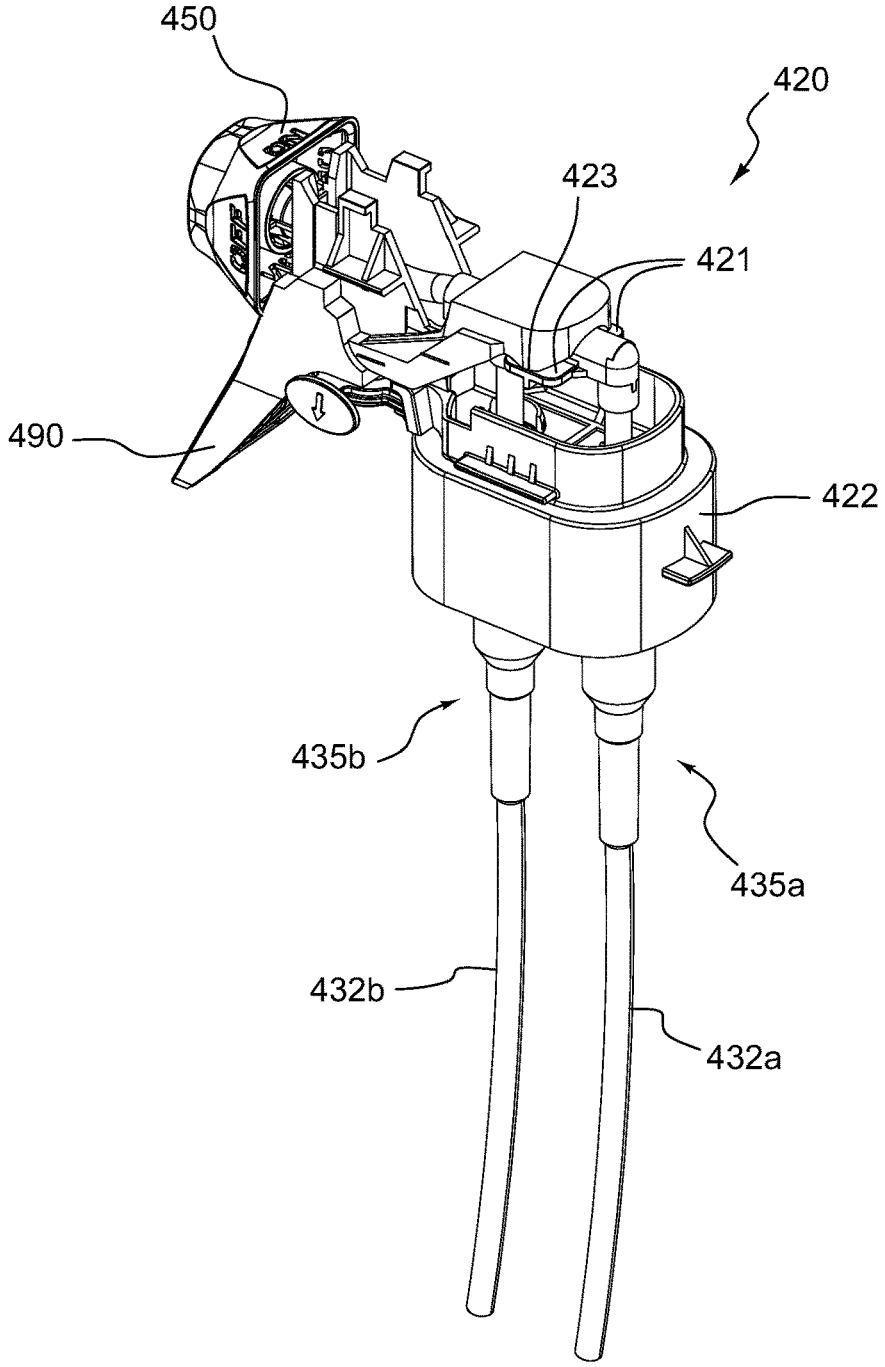
FIG. 20B shows a rear perspective view of the dispensing head of the device of FIG. 17, without the cover.

Dispensing head 420 may have similar characteristics as described above in reference to head 320 relative to trigger force for actuation (e.g., less than 15 lbs of force for trigger actuation), and structure on the frame and/or trigger which prevents or minimizes risk of trigger damage associated with reverse actuation motion of the trigger (e.g., a top portion of the trigger may contact a reinforcing flange of the frame, as shown and described in conjunction with FIG. 16). The bottom portion of the trigger 490 may similarly be used as a single point of contact to support at least 12 lbs of force, reducing risk of trigger damage when the dispensing device is hung from a cart or similar. Various other features described in the context of other embodiments may of course be provided within dispensing head 420.

Figure 23:
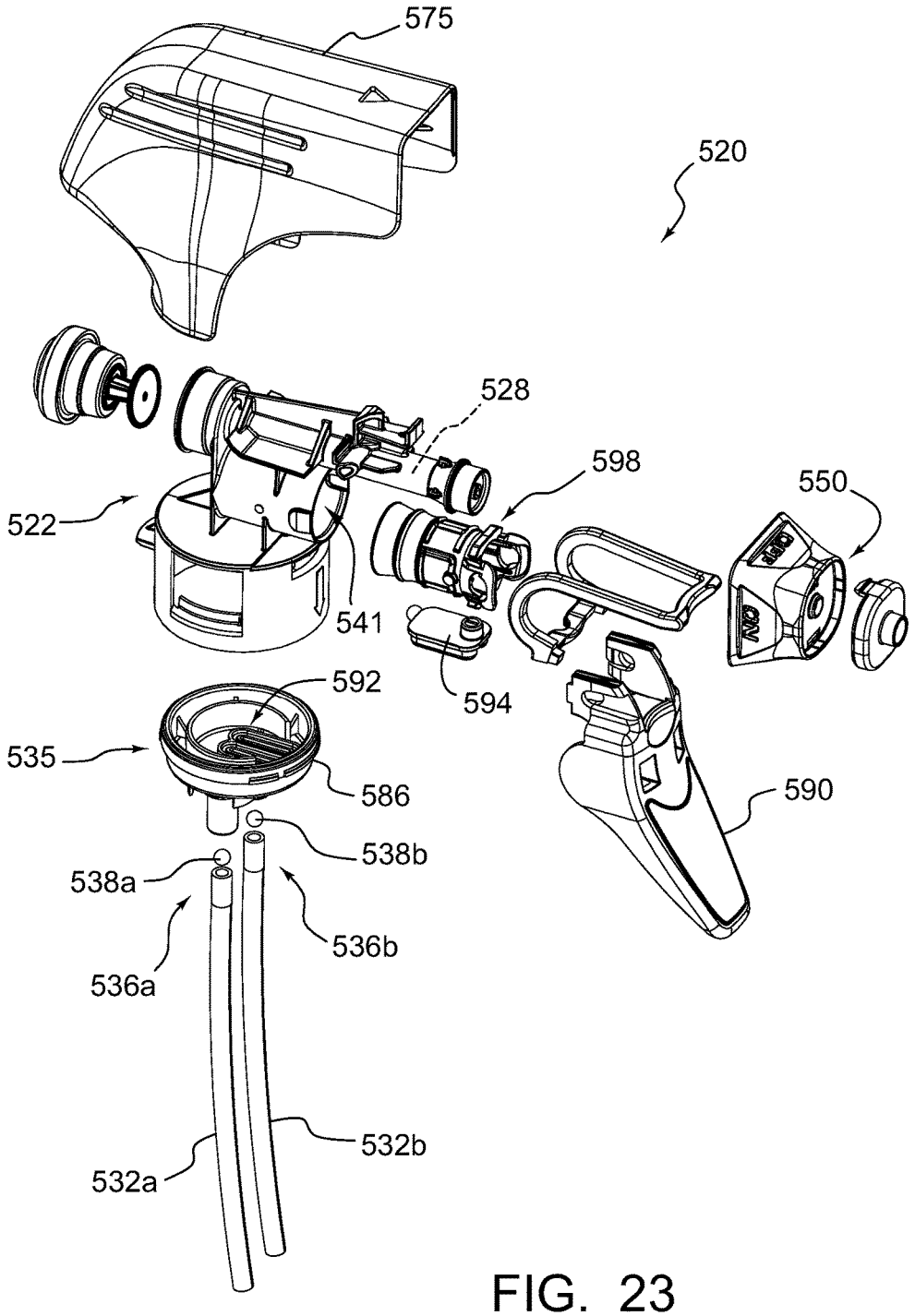
FIG. 23 shows an exploded view of the dispensing head of the device of FIG. 22.
Figure 24A:
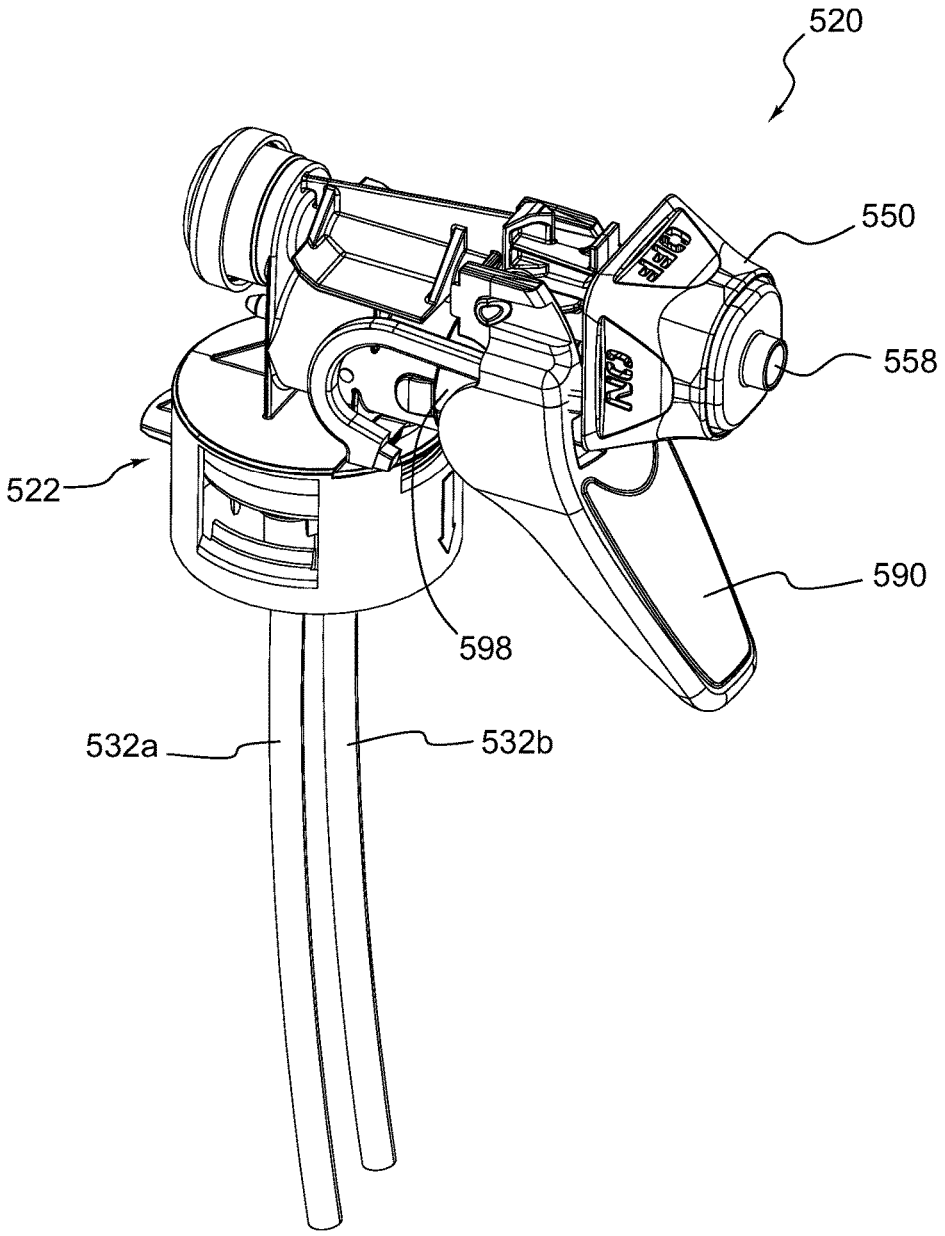
FIG. 24A shows a front perspective view of the dispensing head of the device of FIG. 22, without the cover.
Figure 24B:
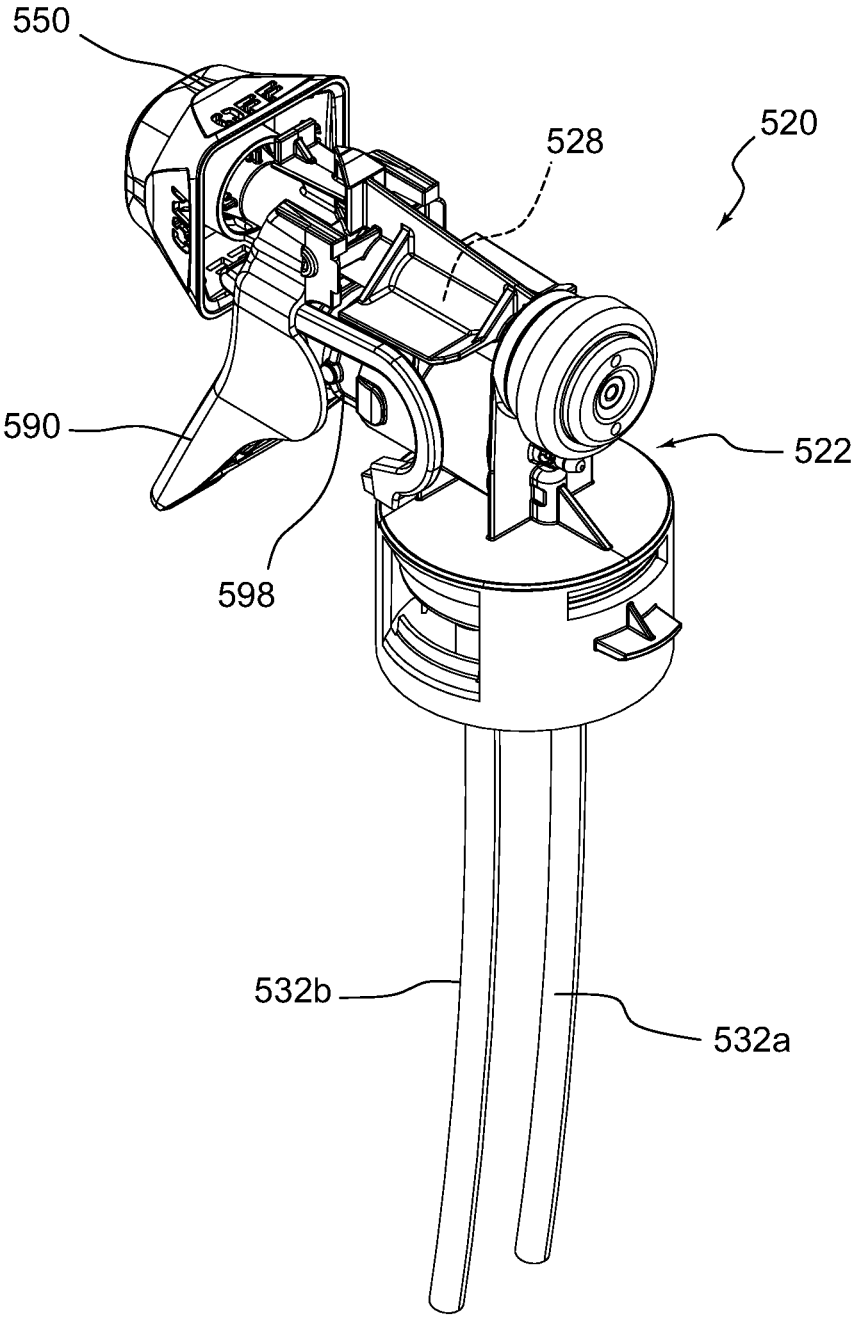
FIG. 24B shows a rear perspective view of the dispensing head of the device of FIG. 22, without the cover.
Figure 25:
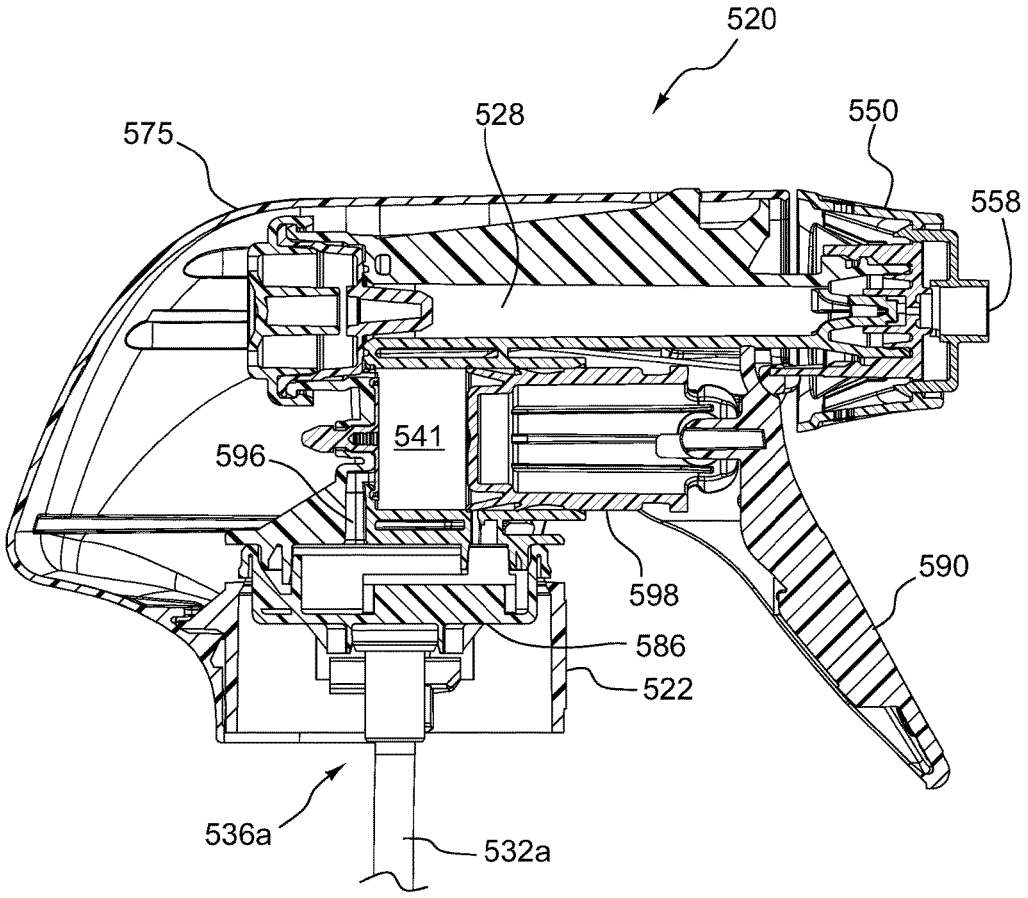
FIG. 25 shows a cross-sectional view through the dispensing head of the device of FIG. 17.
Figure 26A:
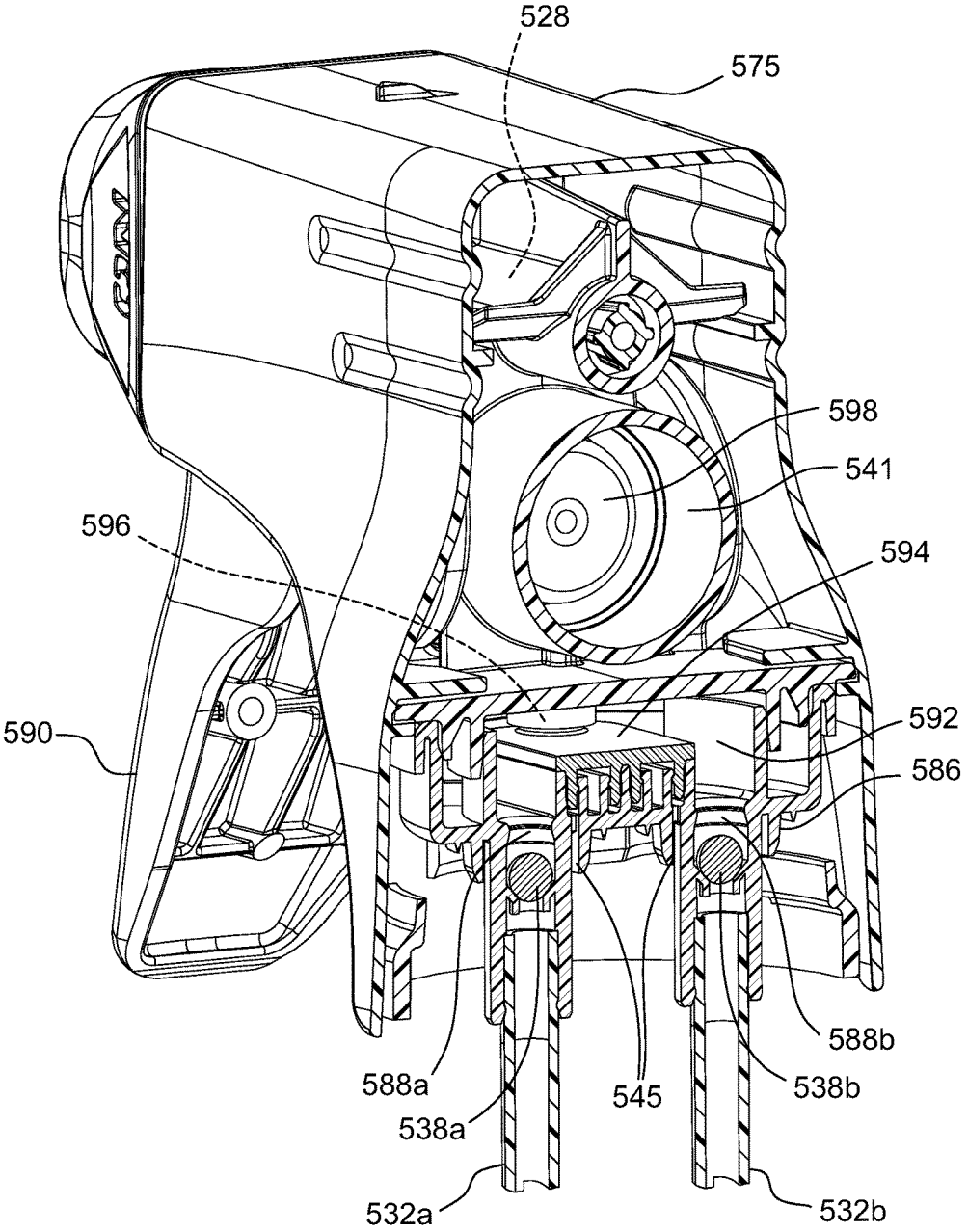
FIGS. 26A-26E show various views of the pump components within the dispensing head of the device of FIG. 17.
Figure 26B:
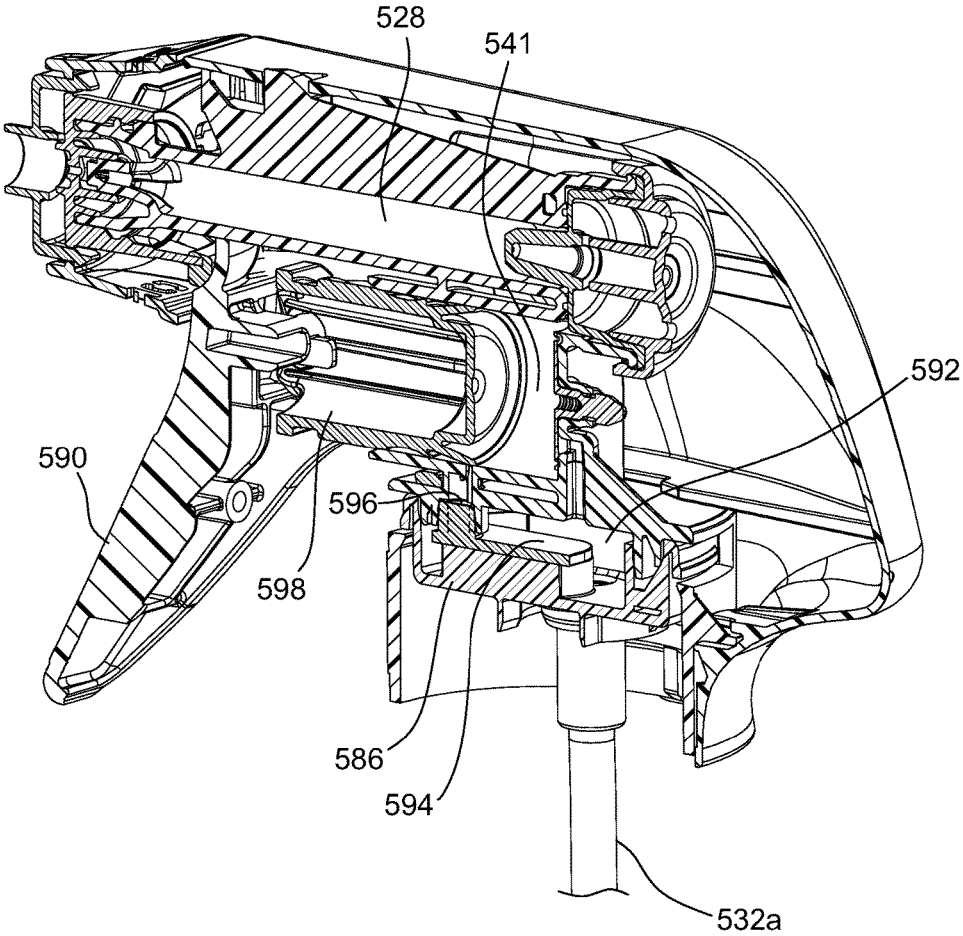
Figure 26D:
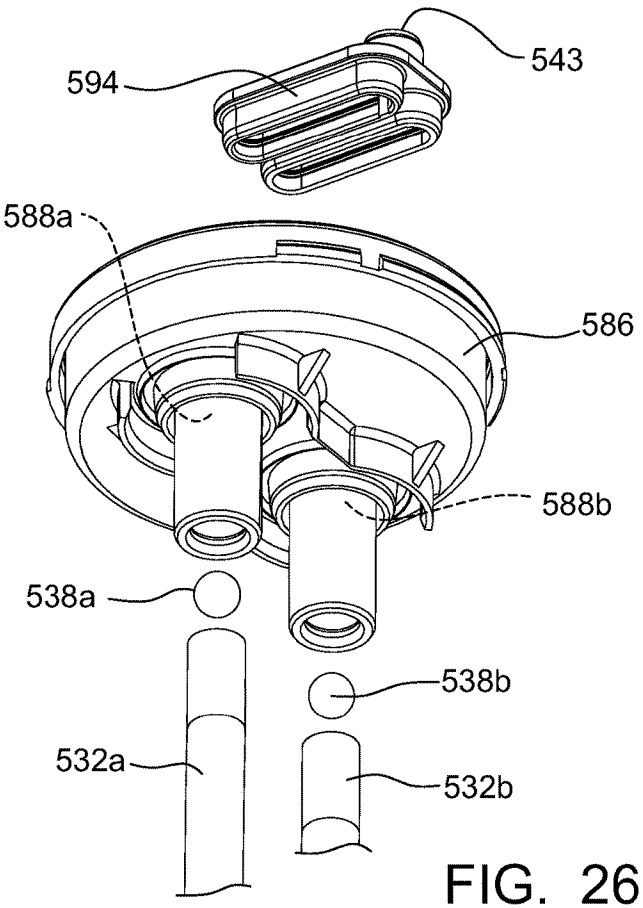
Figure 26C:
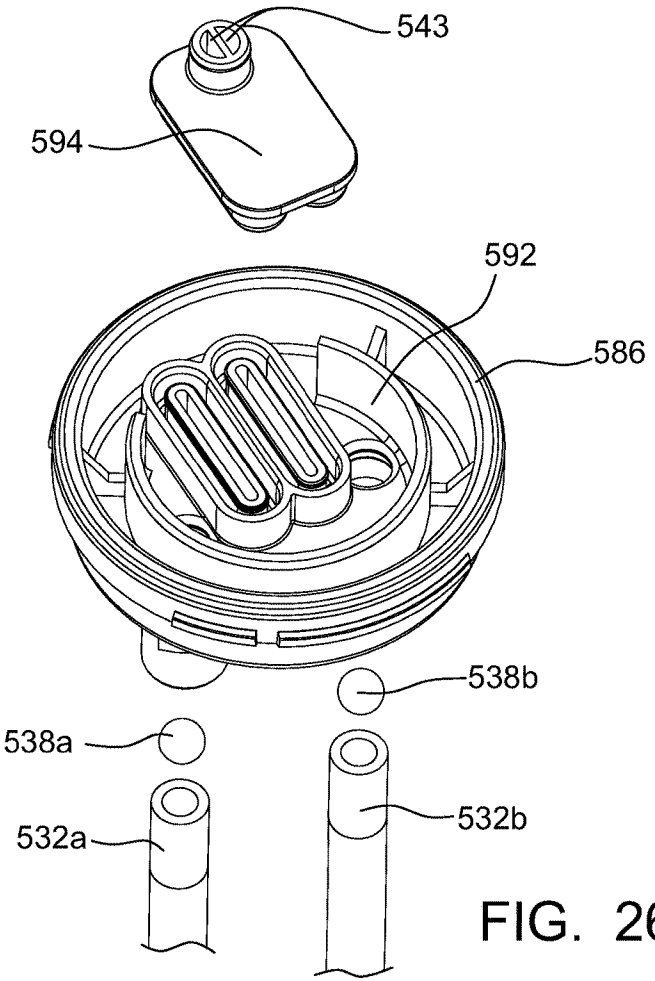
Figure 26E:
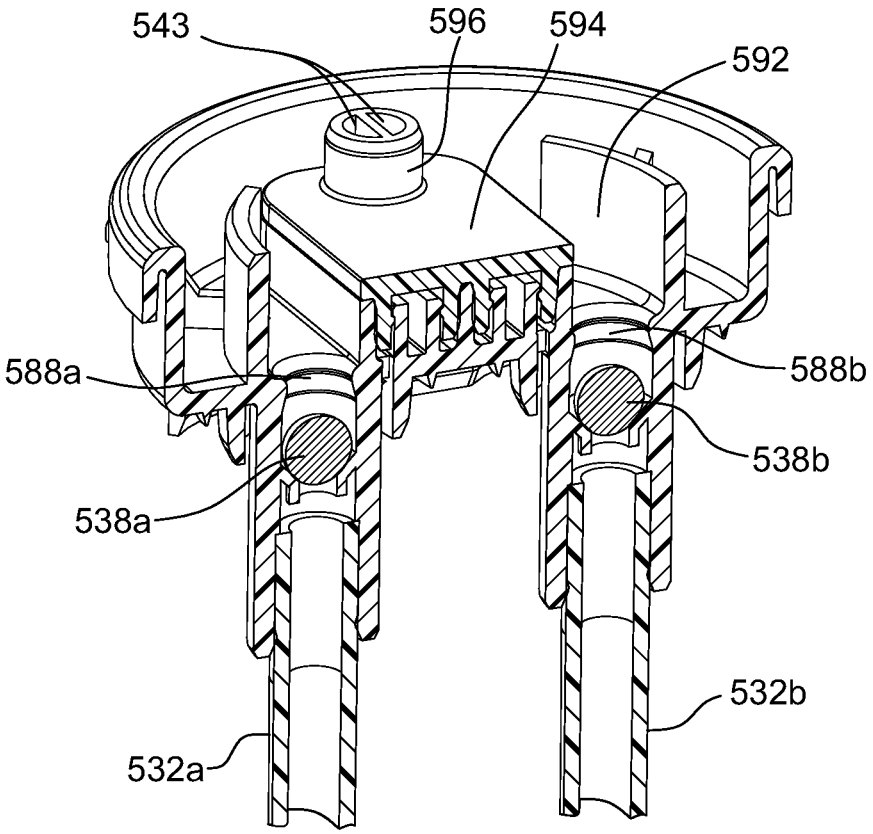

FIGS. 22-26E show a dispensing device 501 similar to the other dispensing devices described herein. Device 501 is similar in many respects to dispensing device 401, e.g., particularly in that it provides for mixing of the two components prior to reaching nozzle 550. As shown in FIG. 23, the dip tubes 532*a*, 532*b* may be arranged aligned side to side, rather than front to back (although of course front to back alignment may also be possible). In addition, the pump mechanism differs from those shown above, being similar to the configuration described in U.S. Pat. Nos. 8,038,040; 8,408,429; 8,408,430; 8,453,950; 8,627,985; 8,839,992; 8,297,479; 8,608,033; 8,474,659; 8,931,668; D651,907; and U.S. Publication No. 2015/0041490. Each of the foregoing is herein incorporated by reference in its entirety. A main difference between the above references and the presently disclosed structures is that the presently disclosed dispensing device has been adapted for dispensing two components, using two dip tubes, a mixing chamber 592 with dual inlets 588*a*, 588*b*, and associated modifications to accommodate mixing of two components.

Even with a different pump mechanism, device 501 may include many similar components as the other dispensing devices described herein, e.g., a bottle 506 including a first compartment 502 and a second compartment 504 may be provided, with associated necks that may include appropriate bottle coupling portions (e.g., one or more coupling fins) to allow dispensing head 520 to snap or otherwise couple onto bottle 506. Bottle 506 may include a front side 503, a back side 505, and a bottom 507. The exterior appearance of dispensing head 520 may be quite similar to the other dispensing heads described herein. In addition to dip tubes 532*a*, 532*b*, dispensing head 520 is shown including a pump 535 in fluid communication with the dip tubes. It will be appreciated that in some embodiments, a single pump may thus be provided, to pull liquid from both dip tubes, rather than providing separate pumps for each dip tube.

A trigger 590, cover 575, nozzle 550, and nozzle dispensing opening 558 are also shown, being similar to those of the embodiments described previously. Pump 535 may include check valves 536*a*, 536*b*, e.g., each including an obturator 538*a*, 538*b* (e.g., ball check valve or other back-flow preventer) to selectively allow one directional flow up through dip tubes 532*a*, 532*b*. Obturators 538*a*, 538*b* (ball check-valve or other back-flow preventer) may rest on an obturator plate, as described above relative to other embodiments. A pump body 586 may be provided, which includes inlets 588*a*, 588*b*, in selective fluid communication with a mixing chamber 592. An adapter plate 594 including an outlet 596 may be disposed over pump body 586, sealing mixing chamber 592. Suction to mixing chamber 592 (and pump 535) may be provided by trigger piston 598 which may be operably coupled to trigger 590. Piston 598 may be disposed within an associated receptacle or recess 541 of frame 522. Upon actuation of trigger 590, a suction force is applied through outlet 596, and mixing chamber 592, pulling fluid up through dip tubes 532*a*, 532*b*. The two liquids mix within chamber 592, and are then directed through outlet 596, through piston recess 541, and into single delivery tube 528.

Adapter plate 594 and/or pump body 586 may include venting channel(s) to allow entrance of venting air into mixing chamber 592. For example, venting channels 543 and/or venting holes 545 may be provided in adapter plate 594 and/or pump both 586, as shown in FIGS. 26A-26E, which show various views of the pump body 586, adapter 594, and associated structures.

As described above, where only a single delivery tube 528 is provided, mixing of the two liquids or other composition components may occur before reaching nozzle 550. Where it is desired to minimize the volume of mixed composition within the dispensing head, it may be preferred to employ configurations that maintain separation of the components within much of the dispensing head, or to at least ensure that the volume of residual mixed composition is relatively small relative to the volume delivered with a single trigger actuation. Alternatively, of course, the user may simply "prime" the dispensing head by spraying out old residual mixed composition prior to the beginning of a new use (e.g., where the residual composition has sat for more than about 2 minutes, or whatever the applicable efficacy lifetime of the mixed composition is).

While shown in the context of two compartment bottles, it will be appreciated that the concepts could be applied to a 3 or more compartment bottle, should delivery of such a 3 or more part composition be desired.

An exemplary two-part composition to be dispensed through fluid dispensing devices may include a bleach composition in the first part, and a bleach activator in the second part. A wide variety of other compositions (e.g., typically liquids) where it is beneficial to store the two parts of the composition separately from one another, and to provide for mixing at the time of dispensing (e.g., by spraying) may also be dispensed using such dispensing devices, such that the bleach and bleach activator composition is merely exemplary. An example bleach and bleach activator composition may be as follows. The vast majority of the composition (e.g., 90% or more, 95% or more) may comprise water. The pH of parts A and B may be from 3 to 5 (e.g., about 3.5 to about 5), and 10 to 12 (e.g., about 10.5 to about 11.5), respectively. Upon mixing at a 1:1 volumetric ratio, the resulting mixed composition may have a pH from about 5 to about 7 (e.g., from about 5.5 to about 6).

| Component | Function | Compartment A or B | Wt % in A or B |
|---|---|---|---|
| Sodium Hypochlorite | Disinfection | B | 0.01 to 10 |
| Sodium Carbonate | Buffer | B | 0.01 to 10 |
| Sodium Citrate | Bleach Activator | A | 0.1 to 10 |
| Succinic Acid | Buffer | A | 0.01 to 10 |
| Decyl(sulfophenoxy)Benzenesulfonic Acid, disodium salt | Surfactant | A | 0.1 to 10 |
| Sodium Xylene Sulfonate | Hydrotrope | A | 0.001 to 1 |
| Hydrochloric acid | Acidic pH Adjuster | A | 0.1 to 10 |

A wide variety of cleaning or other spray dispensed compositions may be delivered. Examples of components that may be included in cleaning compositions include, but are not limited to one or more of an oxidant (e.g., bleaching agent), bleach activator, electrolyte, surfactant, solvent, antimicrobial agent, buffer, stain and soil repellant, lubricant, odor control agent, perfume, fragrance, fragrance release agent, acid, base, dyes and/or colorant, solubilizing material, stabilizer, thickener, defoamer, hydrotrope, cloud point modifier, preservatives, polymer, and combinations thereof.

Exemplary oxidants include, but are not limited to, hydrogen peroxide, alkaline metal salts and/or alkaline earth metal salts of hypochlorous acid (e.g., sodium hypochlorite), hypochlorous acid, solubilized chlorine, any source of free chlorine, solubilized chlorine dioxide, acidic sodium chlorite, active chlorine generating compounds, active oxygen generating compounds, chlorine-dioxide generating compounds, solubilized ozone, sodium potassium peroxysulfate, sodium perborate, and combinations thereof. When present, the one or more oxidants can be present at a level of from 0.001% to 10%, from 0.01% to 10%, from 0.1% to 5%, or from 0.5% to 2.5% by weight.

Bleach activators including salts of organic acids (e.g., sodium citrate) may be included in a part separate from the bleach oxidant. Other suitable activators will be apparent to those of skill in the art. When present, the one or more activators can be present at a level of from 0.01% to 10%, from 0.1% to 10%, 1% to 8%, or from 1% to 5% by weight.

Buffers, buffering agents and pH adjusting agents, when used, include, but are not limited to, organic acids, mineral acids, alkali metal and alkaline earth salts of silicate, metasilicate, polysilicate, borate, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2methylpropanol. Exemplary buffering agents include dicarboxlic acids, such as, succinic acid and glutaric acid. Other exemplary buffers include ammonium carbamate, citric acid, and acetic acid. Mixtures of one or more buffers may also be acceptable. Useful inorganic buffers/alkalinity sources include ammonia, the alkali metal carbonates and alkali metal phosphates, e.g., sodium carbonate, sodium polyphosphate. By way of example, when present, the buffer may be preferably present at a concentration of from about 0.001% to about 20%, from about 0.05% to about 1%, from about 0.05% to about 0.5%, or from about 0.1% to about 0.5% by weight.

The cleaning compositions may include antimicrobial (germicidal) agents or biocidal agents. Such antimicrobial agents can include, but are not limited to, alcohols, chlorinated hydrocarbons, organometallics, halogen-releasing compounds, metallic salts, pine oil, organic sulfur compounds, iodine compounds, silver nitrate, quaternary ammonium compounds (quats), chlorhexidine salts, and/or phenolics. Antimicrobial agents suitable for use in the compositions of the present invention are described in U.S. Pat. Nos. 5,686,089; 5,681,802, 5,607,980, 4,714,563; 4,163,800; 3,835,057; and 3,152,181, each of which is herein incorporated by reference in its entirety.

Suitable antimicrobial agents include alkyl alpha-hydroxyacids, aralkyl and aryl alpha-hydroxyacids, polyhydroxy alpha-hydroxyacids, polycarboxylic alpha-hydroxyacids, alpha-hydroxyacid related compounds, alpha-ketoacids and related compounds, and other related compounds including their lactone forms. Preferred antimicrobial agents include, but are not limited to, alcohols, chlorinated hydrocarbons, organometallics, halogen-releasing compounds, metallic salts, pine oil, organic sulfur compounds, iodine, compounds, antimicrobial metal cations and/or antimicrobial metal cation-releasing compounds, chitosan, quaternary alkyl ammonium biocides, phenolics, germicidal oxidants, germicidal essential oils, germicidal botanical extracts, alpha-hydroxycarboxylic acids, and combinations thereof. When included, the one or more antimicrobial agents may be present at a concentration of from about 0.001% to about 10%, from about 0.05% to about 1%, from about 0.05% to about 0.5%, or from 0.1% to about 0.5% by weight.

Water may be used as a solvent alone, or in combination with any suitable organic solvents. Such solvents may include, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. In one embodiment of the invention, water may comprise at least 30%, at least 40%, at least 50%, at least 60%, at least 70%, at least 80%, at least 90%, or at least 95% of a cleaning composition by weight. Where included, one or more organic solvents can be present at a level of from 0.001% to 10%, from 0.01% to 10%, from 0.1% to 5%, or from 1% to 2.5% by weight.

A cleaning composition may contain surfactants selected from nonionic, anionic, cationic, ampholytic, amphoteric and zwitterionic surfactants and mixtures thereof. A typical listing of anionic, ampholytic, and zwitterionic classes, and species of these surfactants, is given in U.S. Pat. No. 3,929,678 to Laughlin and Heuring. A list of suitable cationic surfactants is given in U.S. Pat. No. 4,259,217 to Murphy. Where present, the one or more surfactants may be present at a level of from 0% to about 90%, from about 0.001% to about 50%, or from about 0.01% to about 25% by weight. Alternatively, surfactants may be present at a level of from about 0.1% to about 10%, from about 0.1% to about 5%, or from about 0.1% to 1% by weight. All such weight percentages may be by percentage of the overall mixed composition, or by percentage of the part in which the component is included.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A fluid dispensing device comprising:

(a) a bottle having a front side, a back side, a bottom, a neck top and a bottle coupling portion below the neck top;

(b) the bottle comprising a first compartment and a second compartment;

(c) a dispensing head comprising a frame, a trigger, a first pump and a second pump;

(d) a first dip tube fluidly connected to the first pump and an interior volume of the first compartment housing a first fluid;

(e) a second dip tube fluidly connected to the second pump and an interior volume of the second compartment housing a second fluid;

(f) a single delivery tube fluidly connected to the first pump and the second pump;

(g) a transmission member which translates actuation of the trigger to substantially simultaneous reciprocation of both the first and second pumps and wherein the transmission member engages with the trigger so that a rotation of the trigger corresponds to a counter-rotation of the transmission member; and (h) a nozzle which fluidly communicates with the single delivery tube;

wherein the single delivery tube is fluidly connected to the first and second pumps so that the first fluid and second fluid first come into contact with one another in the single delivery tube.

2. The fluid dispensing device of claim 1, wherein the trigger includes a top portion which contacts a reinforcing flange on the frame which prevents reverse actuation motion of the trigger.

3. The fluid dispensing device of claim 1, wherein the first dip tube and the second dip tube are aligned, one behind the other relative to the nozzle of the fluid dispensing device.

4. The fluid dispensing device of claim 1, wherein the first pump and the second pump are aligned, one behind the other relative to the nozzle of the fluid dispensing device.

5. The fluid dispensing device of claim 1, wherein the first pump and the second pump deliver substantially the same volume of the first and second fluids, respectively, to the nozzle substantially simultaneously to allow the dispensing device to aspirate a 1:1 mixture of the first and second fluids.

6. A fluid dispensing device comprising:

(a) a bottle having a front side, a back side, a bottom, a first neck, a second neck, and a bottle snap coupling below a top of the first and second necks;

(b) the bottle comprising a first compartment adjacent a front side of the bottle, and a second compartment adjacent a back side of the bottle;

(c) a dispensing head comprising a frame, a trigger, a first pump and a second pump;

(d) a transmission member which translates actuation of the trigger to substantially simultaneous reciprocation of both the first and second pumps and wherein the transmission member engages with the trigger so that a rotation of the trigger corresponds to a counter-rotation of the transmission member;

(e) a first dip tube fluidly connected to the first pump and an interior volume of the first compartment housing a first fluid;

(f) a second dip tube fluidly connected to the second pump and an interior volume of the second compartment housing a second fluid;

(g) a single delivery tube fluidly connected to the first pump and the second pump; and (h) a nozzle which fluidly communicates with the single delivery tube;

wherein the first pump and the second pump are aligned, one behind the other relative to the nozzle of the fluid dispensing device.

7. The fluid dispensing device of claim 6, wherein the trigger includes a top portion which contacts a reinforcing flange on the frame which prevents reverse actuation motion of the trigger.

8. The fluid dispensing device of claim 6, wherein the transmission member is positioned above the single delivery tube.

9. The fluid dispensing device of claim 6, wherein the single delivery tube is above the first and second pumps.

10. The fluid dispensing device of claim 6, wherein the first pump and the second pump deliver substantially the same volume of the first and second fluids, respectively, to the single delivery tube, substantially simultaneously to allow the dispensing device to aspirate an approximately 1:1 mixture of the first and second fluids for delivery.

11. A fluid dispensing device comprising:

(a) a bottle having a front side, a back side, a bottom, a first neck, a second neck, and a bottle coupling below a top of the first and second necks;

(b) the bottle comprising a first compartment and a second compartment;

(c) a dispensing head comprising a frame, a trigger, a first pump and a second pump;

(d) a transmission member that engages with the trigger so that a rotation of the trigger corresponds to a counter-rotation of the transmission member which translates actuation of the trigger to reciprocation of both the first and second pumps;

(e) a first dip tube fluidly connected to the first pump and an interior volume of the first compartment housing a first fluid;

(f) a second dip tube fluidly connected to the second pump and an interior volume of the second compartment housing a second fluid;

(g) a single delivery tube fluidly connected to the first pump and the second pump; and (h) a nozzle which fluidly communicates with the single delivery tube.

12. The fluid dispensing device of claim 11, wherein the trigger requires less than about 15 lbs of force for actuation.

13. The fluid dispensing device of claim 11, wherein the trigger includes a top portion which contacts a reinforcing flange on the frame which prevents reverse actuation motion of the trigger.

14. The fluid dispensing device of claim 11, wherein the bottle coupling is a snap coupling.

15. The fluid dispensing device of claim 11, wherein the nozzle has a breakup unit that mixes the first fluid and the second fluid upon dispensing.

16. The fluid dispensing device of claim 11, wherein the first dip tube is closer to a dispensing end of the device and the second dip tube is closer to a rear end of the device so that the dip tubes are in a front to back alignment relative to the nozzle.

17. The fluid dispensing device of claim 11, wherein the dispensing head further comprises an intermediate body below the transmission member, the intermediate body being pressed downward to substantially simultaneously actuate both the first and second pumps upon actuation of the trigger, which rotates the transmission member to press downward on the intermediate body.

18. The fluid dispensing device of claim 17, wherein the intermediate body, comprises a substantially horizontal platform with one or more reinforcing support ribs attached to the bottom surface of the platform.

* * * * *